US007886403B2

(12) United States Patent
Nezu et al.

(10) Patent No.: US 7,886,403 B2
(45) Date of Patent: Feb. 15, 2011

(54) SELF-PROPELLED FORWARD MOVEMENT MECHANISM FOR A MOVABLE BODY

(75) Inventors: Mikio Nezu, Yokohama (JP); Takahiro Saito, Suita (JP)

(73) Assignee: NIFCO Inc., Yokohama-Shi, Kanagawa (JP)

( * ) Notice: Subject to any disclaimer, the term of this patent is extended or adjusted under 35 U.S.C. 154(b) by 107 days.

(21) Appl. No.: 12/312,854

(22) PCT Filed: Nov. 22, 2007

(86) PCT No.: PCT/JP2007/072678

§ 371 (c)(1),
(2), (4) Date: Jun. 24, 2009

(87) PCT Pub. No.: WO2008/065971

PCT Pub. Date: Jun. 5, 2008

(65) Prior Publication Data

US 2010/0043172 A1 Feb. 25, 2010

(30) Foreign Application Priority Data

Nov. 30, 2006 (JP) ..... 2006-323409
Apr. 9, 2007 (JP) ..... 2007-101630

(51) Int. Cl.
*E05D 15/06* (2006.01)

(52) U.S. Cl. ..... 16/87 R; 16/91; 16/93 R; 49/409

(58) Field of Classification Search ..... 16/96 D, 16/91, 102, 106, 107; 49/409, 379, 138, 49/322

See application file for complete search history.

(56) References Cited

U.S. PATENT DOCUMENTS

2007/0186481 A1 * 8/2007 Tomita et al. ..... 49/409

FOREIGN PATENT DOCUMENTS

| | | |
|---|---|---|
| JP | 2005-290769 | 10/2005 |
| JP | 2006-063767 | 3/2006 |
| JP | 2006-169905 | 6/2006 |
| JP | 2006-200298 | 8/2006 |
| JP | 2006-336242 | 12/2006 |
| WO | WO 2007/122831 | 11/2007 |

* cited by examiner

*Primary Examiner*—Victor Batson
*Assistant Examiner*—Matthew Sullivan
(74) *Attorney, Agent, or Firm*—Manabu Kanesaka

(57) ABSTRACT

A runner 5 including a striker 51 in a lower portion; a catcher 6 corresponding to the striker 51 and engaging a movable body 1 in a reference position R; and an urging device 7 storing an urging force when the catcher 6 is in the reference position R, are provided. The catcher 6 in the reference position R captures the striker 51 of the runner 5 stopped and engaged with a rail 2 in a self-propelling start position SA of the movable body 1, and upon this capture, an engagement between the catcher 6 and the movable body 1 is released. At the same time, due to a backward movement of the movable body 1 from the stop position SA, the catcher 6 is positioned in the reference position R again, and releases the striker 51 of the runner 5. An engagement between the runner 5 and the rail 2 is subsequently released.

7 Claims, 18 Drawing Sheets

SELF-PROPELLED FORWARD MOVEMENT MECHANISM FOR A MOVABLE BODY

FIELD OF THE INVENTION

The invention relates to a mechanism which moves a movable body whose upper portion is hung from a rail and supported, and after the movable body is moved forward to a self-propelling start position, moves the movable body forward to a stop position by self propulsion.

BACKGROUND OF THE ART

Usually, a movable body such as an overhung door whose upper portion is hung and supported from a rail, is manually moved forward to a stop position wherein the end face (front end) positioned in the forward movement bumps into the end face of a door stop or another overhung door which is part of a pair, or the like. Here, if a force of a manual forward movement is too strong, the movable body, which has been moved forward, may bounce from the stop position. On the other hand, if the force of the manual forward movement is too weak, the movable body may stop before reaching the stop position.

DISCLOSURE OF THE INVENTION

Problems to be Solved by the Invention

A main problem to be solved by the present invention is that in a movable body such as this kind of overhung door, after being moved halfway forward manually, the movable body is reliably moved forward to the stop position by self propulsion.

Means for Solving the Problems

In order to solve the above-mentioned problem, in this invention, a self-propelled forward movement mechanism for a movable body comprises the following structures of (1) to (6). The self-propelled forward movement mechanism comprises:

(1) a mechanism wherein the movable body whose upper portion is supported on a rail is moved forward to a stop position by self propulsion after the movable body is moved to a self-propelling start position;

(2) a runner movably attached to the rail, the runner being engaged with a rail at the above-mentioned self-propelling start position and including a striker at a lower portion;

(3) a catcher corresponding to the striker and movably housed in the upper part of the movable body along a moving direction of the movable body, said catcher being engaged with a movable body at a reference position; and (4) urging means configured to store an urging force when the catcher is in the reference position, wherein:

(5) the catcher in the reference position captures the striker of the runner engaged with the rail in the self-propelling start position of the movable body, and the engagement between the catcher and the movable body side is released so that the urging force of the urging means is released upon capturing the striker; and (6) during a backward movement of the movable body to the self-propelling start position from the stop position, the catcher is moved in the reference position again, the striker of the runner is released, and after this, the engagement between the runner and the rail is released.

In a stage before the movable body is moved forward to the self-propelling start position, the catcher is in the reference position and engaged with the movable body. When the movable body is moved forward to the self-propelling start position, the runner is engaged with the rail and comes to a stop. Also, the catcher captures the striker of the runner, and is integrated into the runner which has come to a stop. At the same time, the engagement between the catcher and the movable body is released. Due to the release of this engagement, a stored force of the urging means can be released, so that the movable body can be moved forward to the stop position. When the movable body which has moved forward to the stop position by self propulsion is moved backward to the self-propelling start position, the catcher is relatively moved to the reference position while storing an urging force to the urging means; engaged with the movable body again; and also releases the striker. After this, the engagement between the runner and the rail is released. Therefore, the movable body can be returned to the previous stage wherein the movable body is moved forward to the self-propelling start position wherein the runner and the catcher are separated, and also the runner also moves along the rail with the movement of the movable body.

The above-mentioned mechanism may comprise structures of the following (1) to (11). The mechanism comprises:

(1) a mechanism wherein the movable body hanging from the rail and supported by a hanging wheel is moved forward by self propulsion to the stop position after being moved forward to the self-propelling start position;

(2) a runner movably attached to the rail;

(3) a catcher housed to be movable along the moving direction inside a concave extending along the moving direction of the movable body formed in the upper part of the movable body; and (4) urging means provided to the catcher, wherein (5) the runner includes a runner main body; and a striker projecting downwardly from the runner main body so as to enter into the concave, and positioned in front of the catcher;

(6) the runner main body includes a runner stopper retractably projecting the outer end from the side portion of the runner main body, and always leaving a space between the outer end and the inner surface of the rail; a release part retractably projecting the outer end from the front portion of the runner main body and facing in a direction of a forward movement of the movable body; and an urging body positioning the release part in a projecting position;

(7) the runner stopper is connected in such a way as to be retractable when the release part is retracted against an urging force of the urging body relative to the release part;

(8) the catcher includes a catcher stopper retractably projecting the outer end from the side portion of the catcher main body; and a retaining body of the striker provided in the catcher main body to be movable forward and backward, and receiving the striker from the front in a non-retaining state;

(9) due to the urging body, when the catcher stopper projects the outer end thereof, the retaining body is in an advanced position and the non-retaining state, and also when the retaining body is in a backward position and a retaining state, the catcher stopper retracts the outer end to the inside;

(10) in the concave, an engagement portion on the outer end of the catcher stopper is formed, and in the reference position of the catcher wherein the catcher stopper is engaged with the engagement portion, the urging means can store forces; and

(11) the rail includes a first portion located on an end side of the movable body in a backward movement direction, and also retractably projecting due to an urging force; and a second portion positioned on the end side of the movable body in a forward movement direction. The engagement portion is formed, said engagement portion receiving the outer end of the runner stopper between both portions and engaging with this, and when the movable body is moved to the self-propelling start position, the runner stopper of the runner wherein the striker is advanced into the retaining body of the catcher which is in the reference position, is engaged with the engagement portion.

In the case wherein the self-propelled forward movement mechanism is structured in a way stated above, especially, the outer end of the runner stopper never contacts the inner surface of the rail due to the above-mentioned space, so that the runner stopper does not have a resistance to the movement of the runner during the forward movement to reach to the above-mentioned self-propelling start position of the movable body, and also during the backward movement of the movable body from the self-propelling start position. Accordingly, there is no noise generated during this movement.

Also, when the movable body has moved forward to the self-propelling start position, the runner stopper of the runner which has been pushed by the retaining body of the catcher housed in the concave of the movable body and moved forward together can be bumped into the first portion. Due to this bumping, the first portion is retracted against the above-mentioned urging force, and in a position wherein the runner stopper goes beyond the first portion, due to this urging force, the first portion sticks out again, and the runner stopper is engaged and held between the first portion and the second portion. Hereby, the runner is engaged with the rail and comes to a stop. When the runner comes to a stop, the retaining body is moved backward against an urging force of the above-mentioned urging body by being pushed by the striker. When the retaining body is moved backward, the retaining body is positioned in a retaining state, and the catcher is integrated into the runner which has come to a stop. Also, at the same time, due to the backward movement of this retaining body, the engagement between the catcher stopper and the engagement portion of the concave is released, so that the movable body is moved to the stop position by self propulsion due to the urging force of the urging means.

Also, when the movable body which has moved forward to the stop position by self propulsion is moved backward to the self-propelling start position, the catcher which is integrated into the runner which has come to a stop is relatively moved forward while storing urging forces to the urging means, and in the stage wherein the movable body has reached the self-propelling start position, the catcher stopper is engaged with the engagement portion of the concave due to an urging force of the urging body again. At the same time, the advancement due to an urging force of the urging body of the retaining body becomes possible, so that the retaining body is returned to the non-retaining state, and the catcher and the striker are separated. After this, one portion of the movable body is hit into the release part in the runner which has come to a stop from the front, and the release part can be moved backward against the above-mentioned urging force, and due to the backward movement of the release part, the runner stopper is retracted and the engagement of the engagement portion of the rail is released, so that the runner can be moved backward together with the backward movement of the movable body.

The hanging wheel is provided between the front end of the above-mentioned movable body and the concave, and when the movable body in the stop position is moved backward, the hanging wheel contacts the outer end of the release part, so that the release part is retracted.

In this case, when the movable body which has been moved forward to the stop position by self propulsion is moved backward to the self-propelling start position, the release part can be moved backward against the above-mentioned urging force by contacting the hanging wheel into the release part in the runner which has come to a stop as mentioned above from the front. Accordingly, due to the backward movement of the release part, the runner stopper is retracted, and the engagement of the engagement portion is released, so that the runner can be moved backward together with the backward movement of the movable body.

The wheel traveling on the inner face of the lower portion of the rail may be provided on the side portion of the above-mentioned runner. In this case, accompanied with the forward movement to reach the self-propelling start position of the movable body, and also accompanied with the backward movement of the movable body from the self-propelling start position, the runner can travel smoothly along the rail.

The runner may include a postural retaining portion projecting downwardly through an opening formed at the lower portion of the rail and extending along the length direction of the rail, and located under the outer face of the lower portion of the rail. In this case, due to the above-mentioned postural retaining portion, when the runner travels, it can be prevented from traveling with leaning downwardly on the front side thereof or from leaning downwardly on the back side thereof, and helps the runner travel further smoothly. At the same time, when the movable body is moved forward to the self-propelling start position, the striker is advanced to the retaining body of the hereinafter mentioned catcher without leaning, so that the striker can be reliably retained to the retaining body.

The striker may be rotatably provided in the striker base assembled to the runner main body. In this case, even if any deviation occurs in a supporting position of the movable body and the like with time, the position of the striker can be corrected by the hitting into the retaining body accompanied with the forward movement of the movable body in such a way as to be received by the retaining body.

The striker may be provided with the engagement portions in more than two portions relative to the retaining body with a space along the moving direction of the movable body. In this case, even if the striker enters into the retaining body deeply, or shallowly, the retaining body can be engaged with either one of engagement groove portions, so that the striker and the catcher can be integrated.

EFFECTS OF THE INVENTION

According to a self-propelled forward movement mechanism of the present invention, after a movable body has moved forward to a self-propelling start position, the movable body can be moved to a stop position by self propulsion, and can be reliably moved to the stop position.

BEST MODE FOR CARRYING OUT THE INVENTION

Hereinafter, the best mode for carrying out the present invention will be explained with reference to FIGS. 1 to 19.

Figure 1:
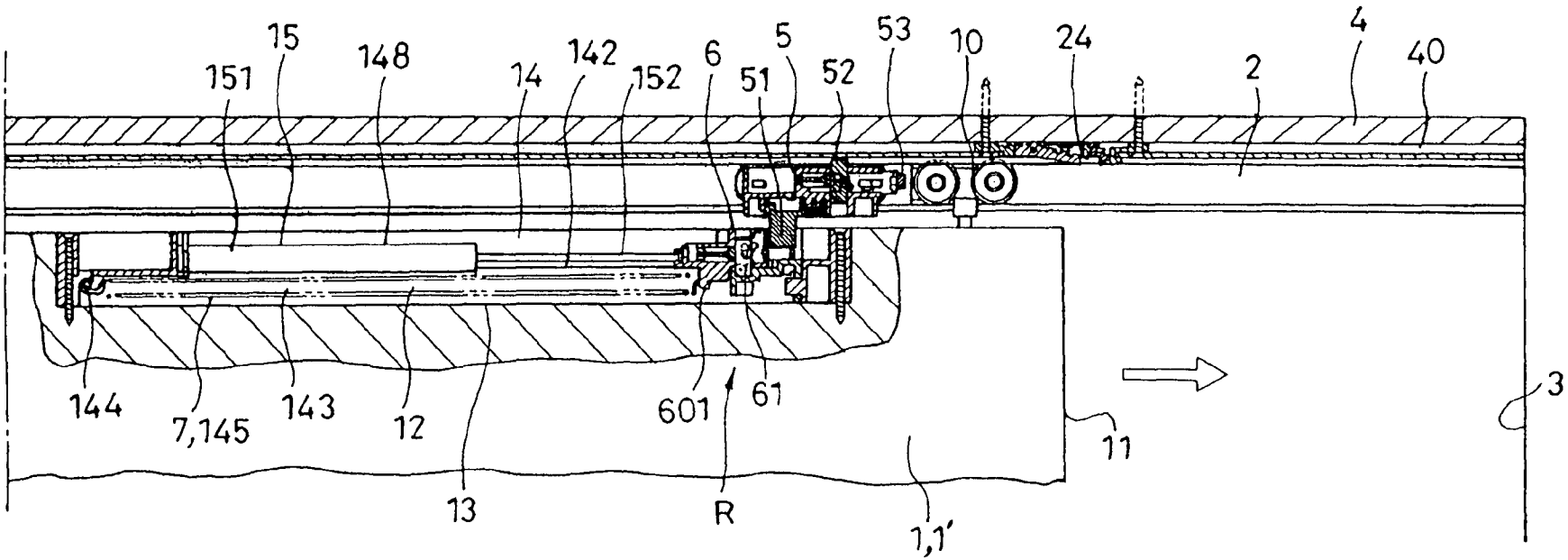
FIG. 1 is a partial sectional front structural view of essential parts of a self-propelled forward movement mechanism.
Figure 2:
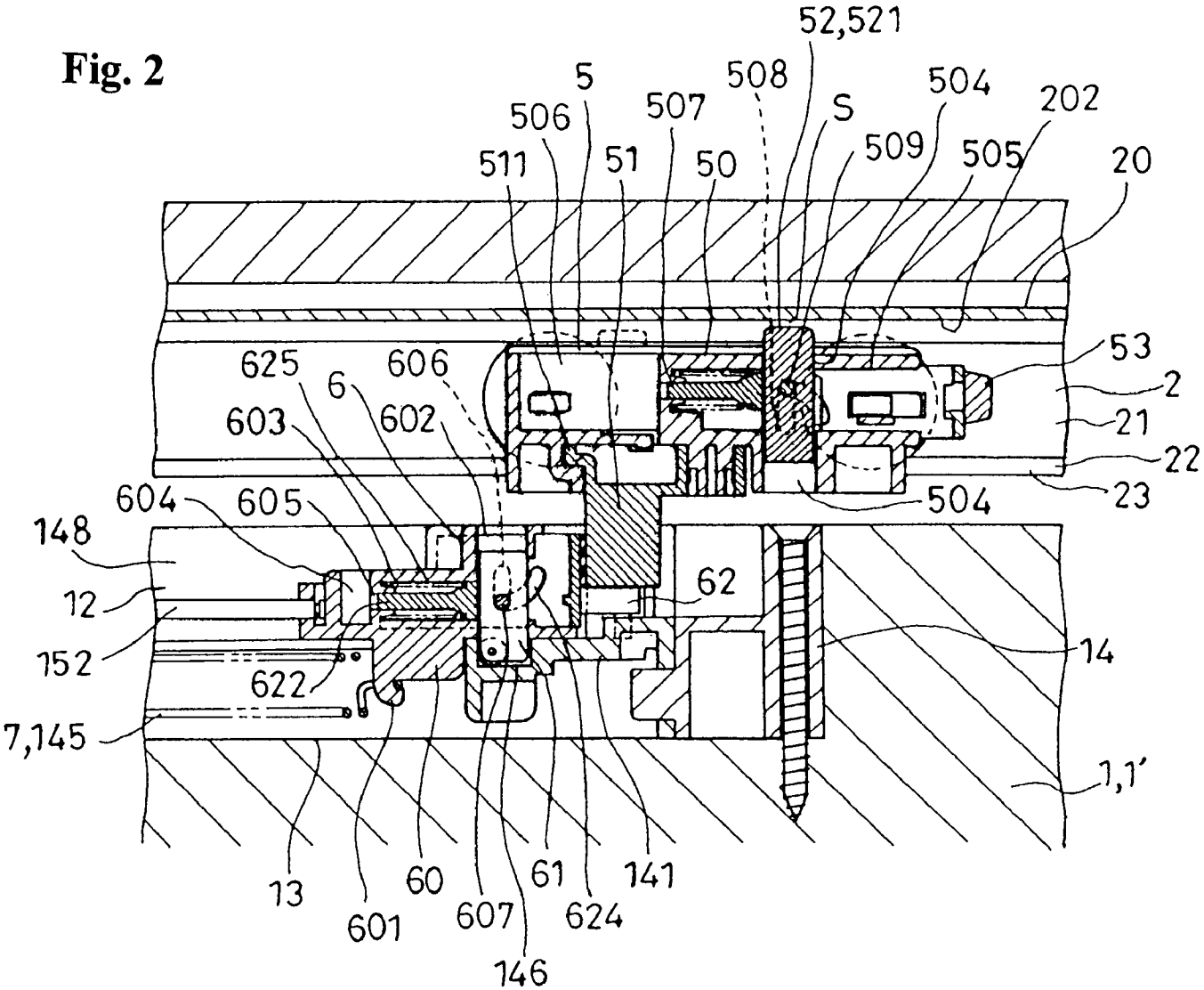
FIG. 2 is an enlarged view of the essential part in FIG. 1.
Figure 3:
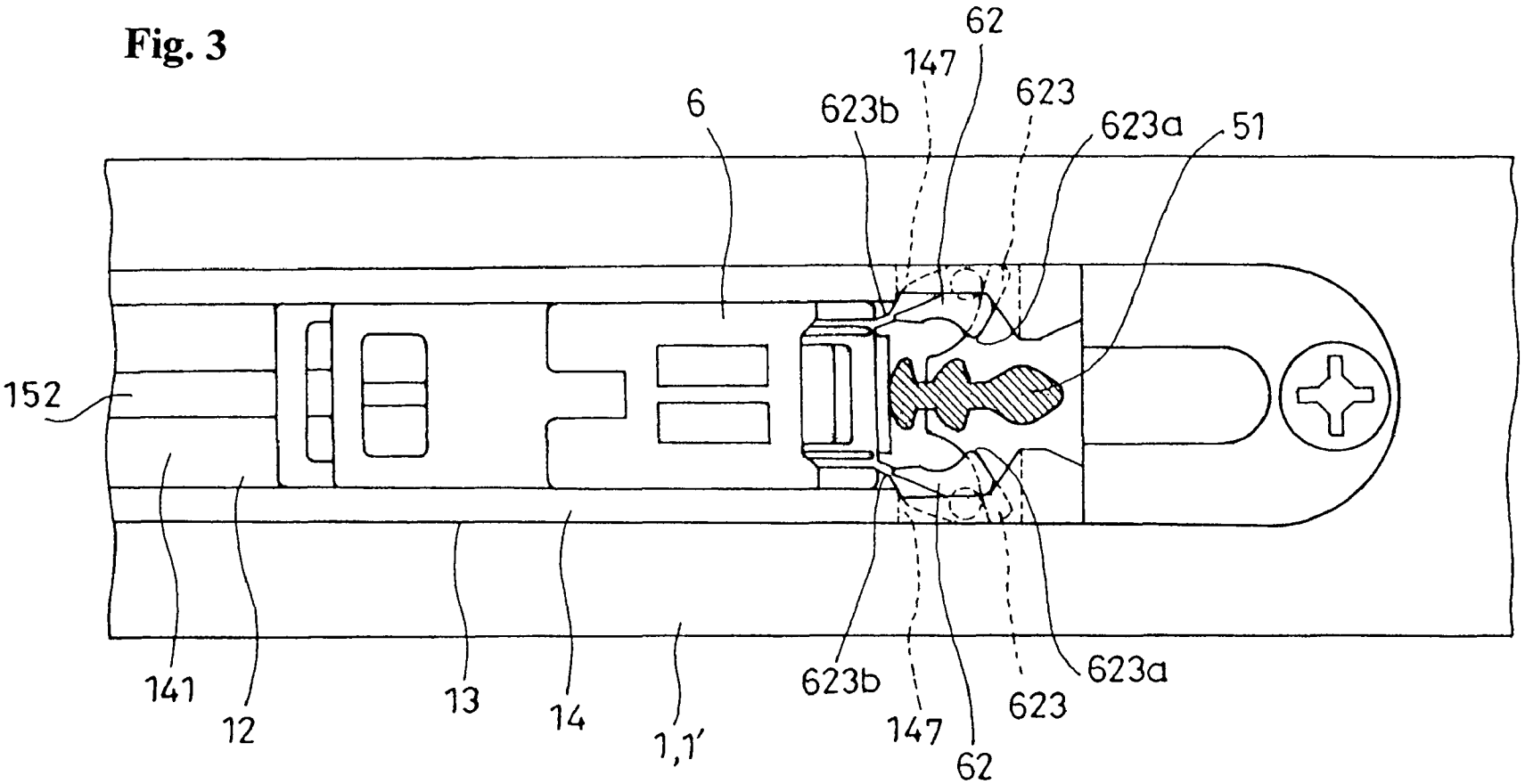
FIG. 3 is an enlarged plan view of the essential part in a state of FIG. 1.
Figure 4:
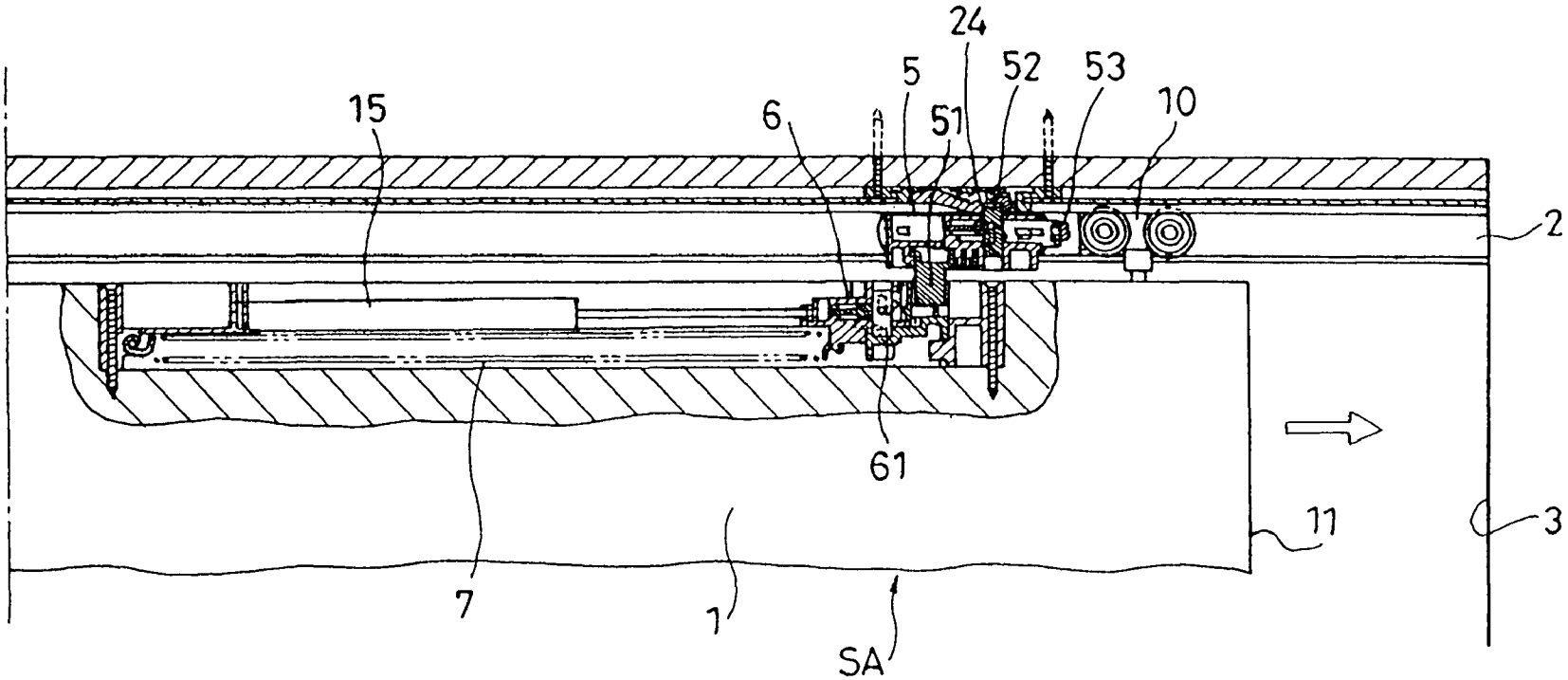
FIG. 4 is a partial sectional front structural view of the essential part of the self-propelled forward movement mechanism.
Figure 5:
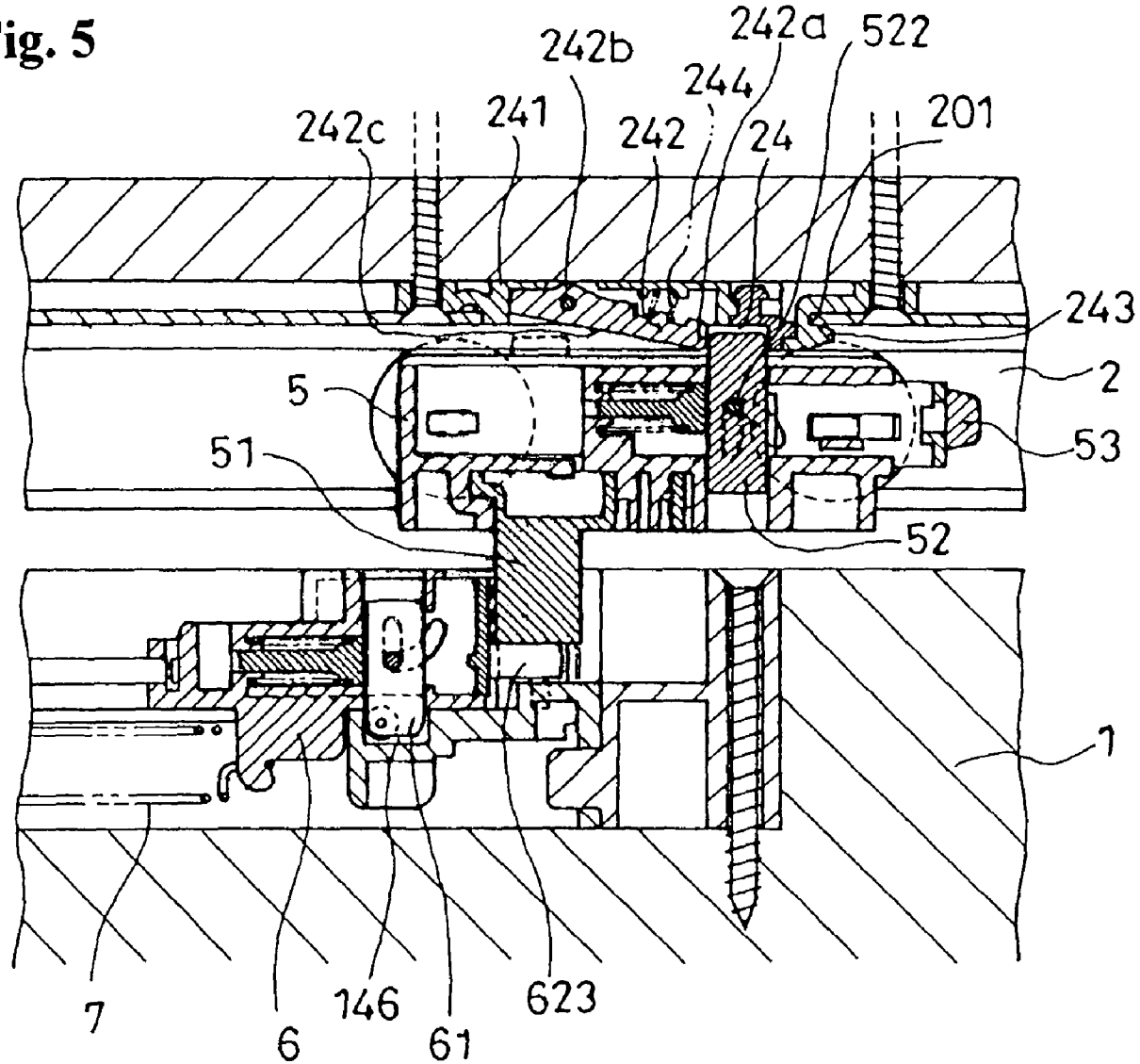
FIG. 5 is an enlarged view of the essential part in FIG. 4.
Figure 6:
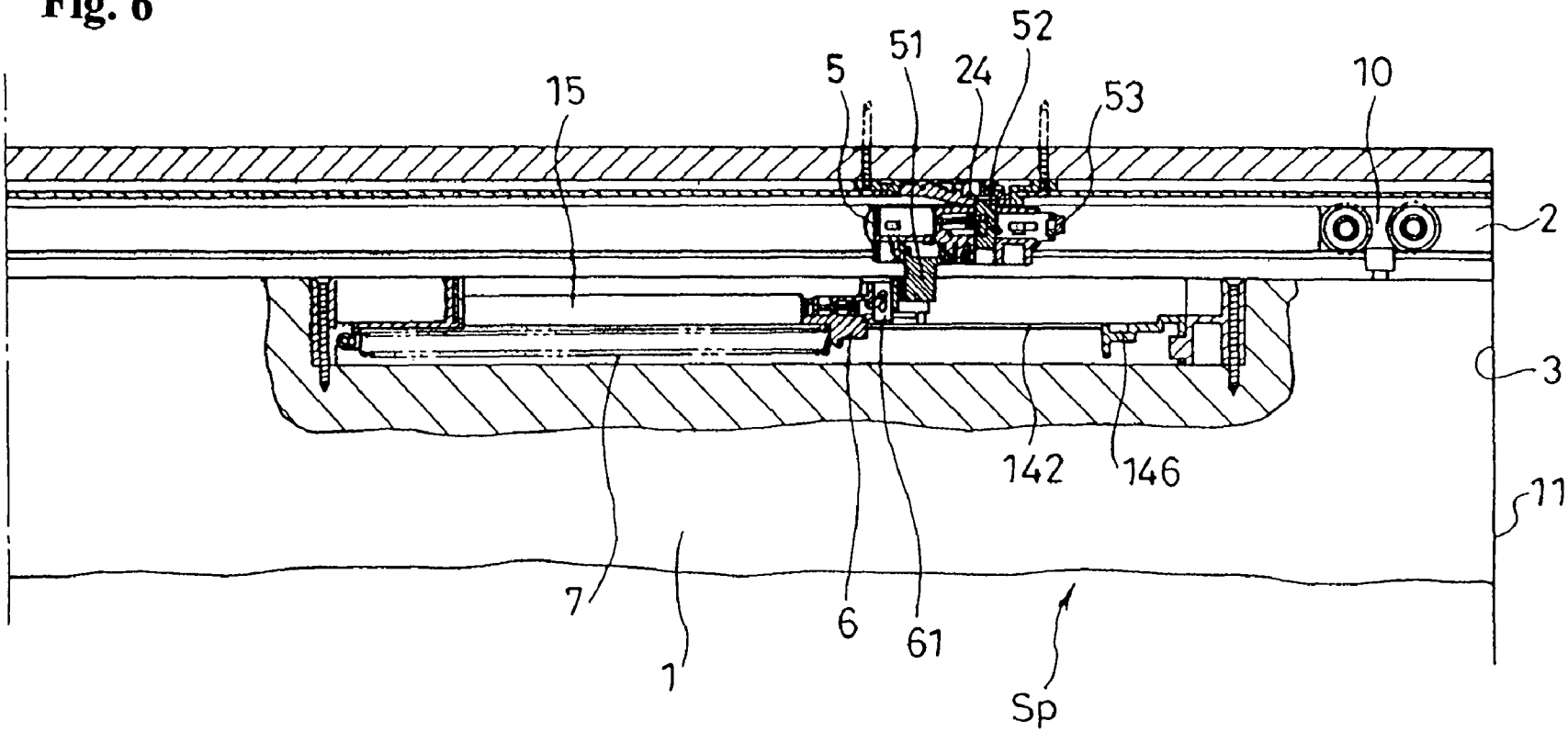
FIG. 6 is a partial sectional front structural view of the essential part of the self-propelled forward movement mechanism.
Figure 7:
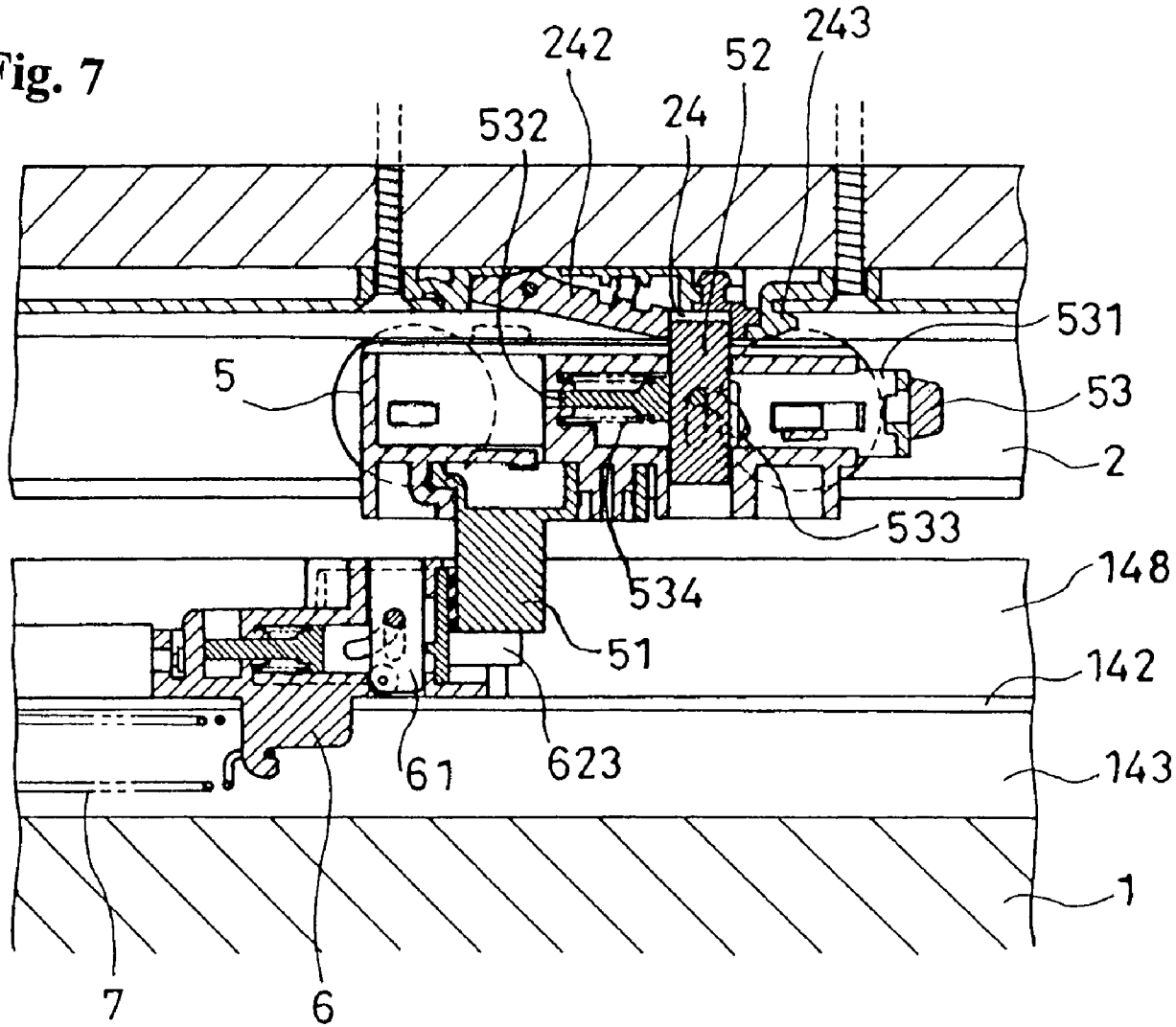
FIG. 7 is an enlarged view of the essential part in FIG. 6.
Figure 8:
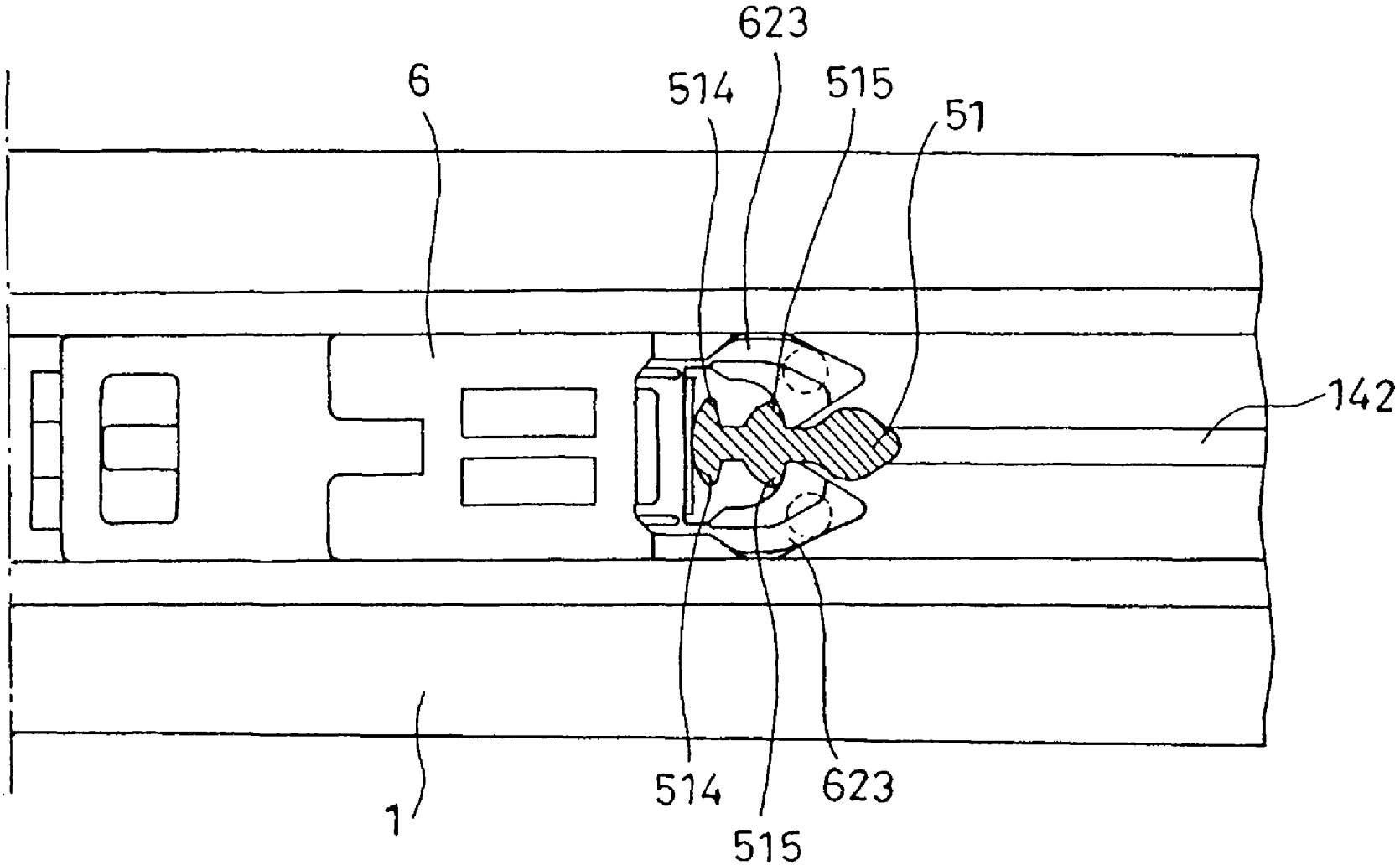
FIG. 8 is an enlarged plan view of the essential part in a state of FIG. 6.
Figure 9:
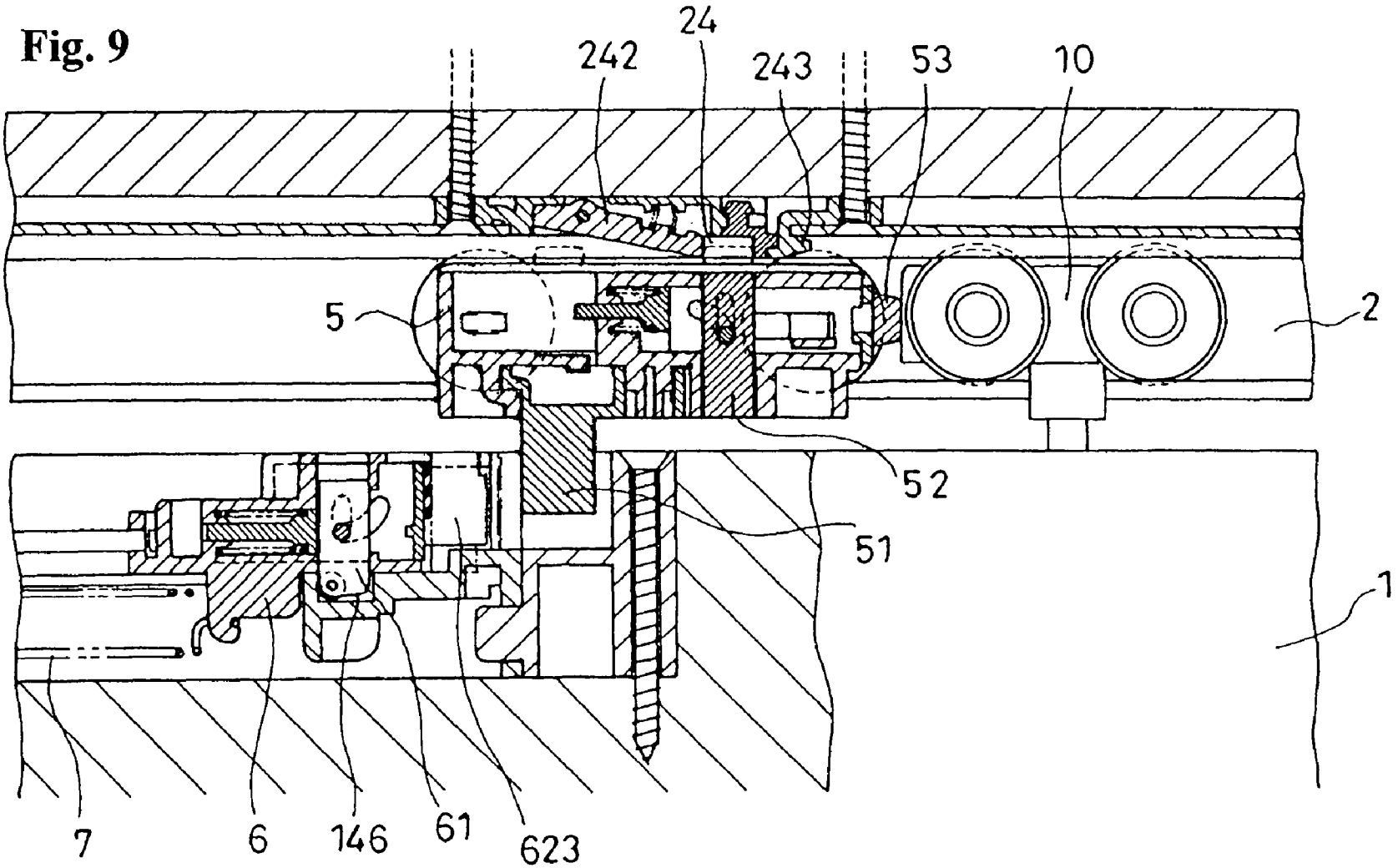
FIG. 9 is an enlarged structural view of the essential part of the self-propelled forward movement mechanism.

Incidentally, here, FIGS. 1 to 3 show a condition wherein a movable body 1 is manually moved forward toward a self-propelling start position SA; FIGS. 4, 5 show a condition wherein the movable body 1 reaches the self-propelling start position SA by a manual forward movement; following that, FIGS. 6 to 8 show a condition wherein the movable body 1 has been completely moved forward by self propulsion; FIG. 9 shows a condition wherein the movable body 1 which is in a stop position SP after being completely moved forward by self propulsion, is manually moved backward to the self-propelling start position SA; and following that, FIGS. 10 to 12 further show a condition at the time the movable body 1 is manually moved backward, respectively.

Figure 13:
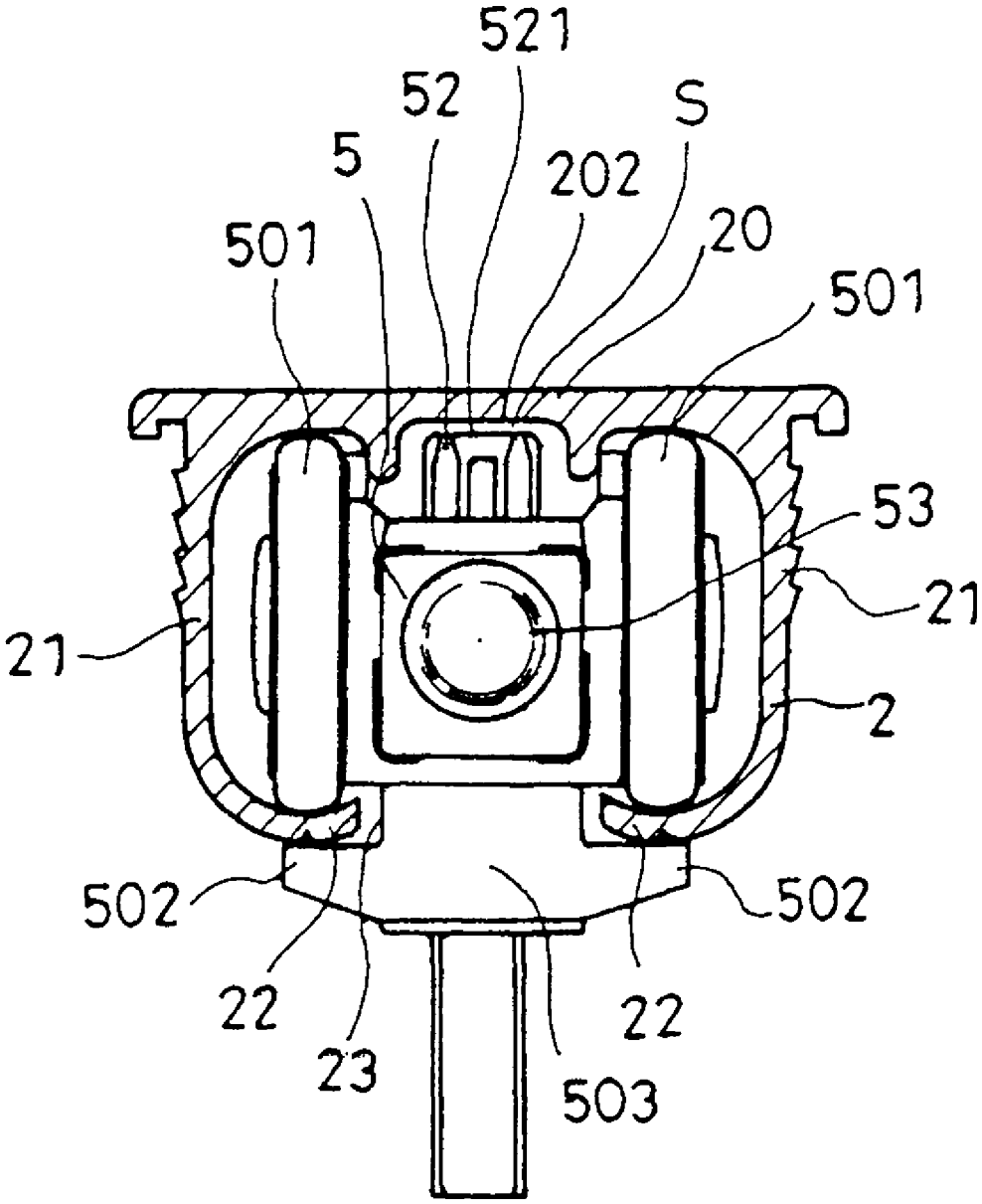
FIG. 13 is a side view showing a runner fit into a rail.

Also, FIG. 13 shows only both a runner 5 and a rail 2 with a cross-sectional view in a width direction of the rail 2 so that a state wherein the runner 5 is housed relative to the rail 2 of a self-propelled forward movement mechanism can be easily understood.

Figure 14:
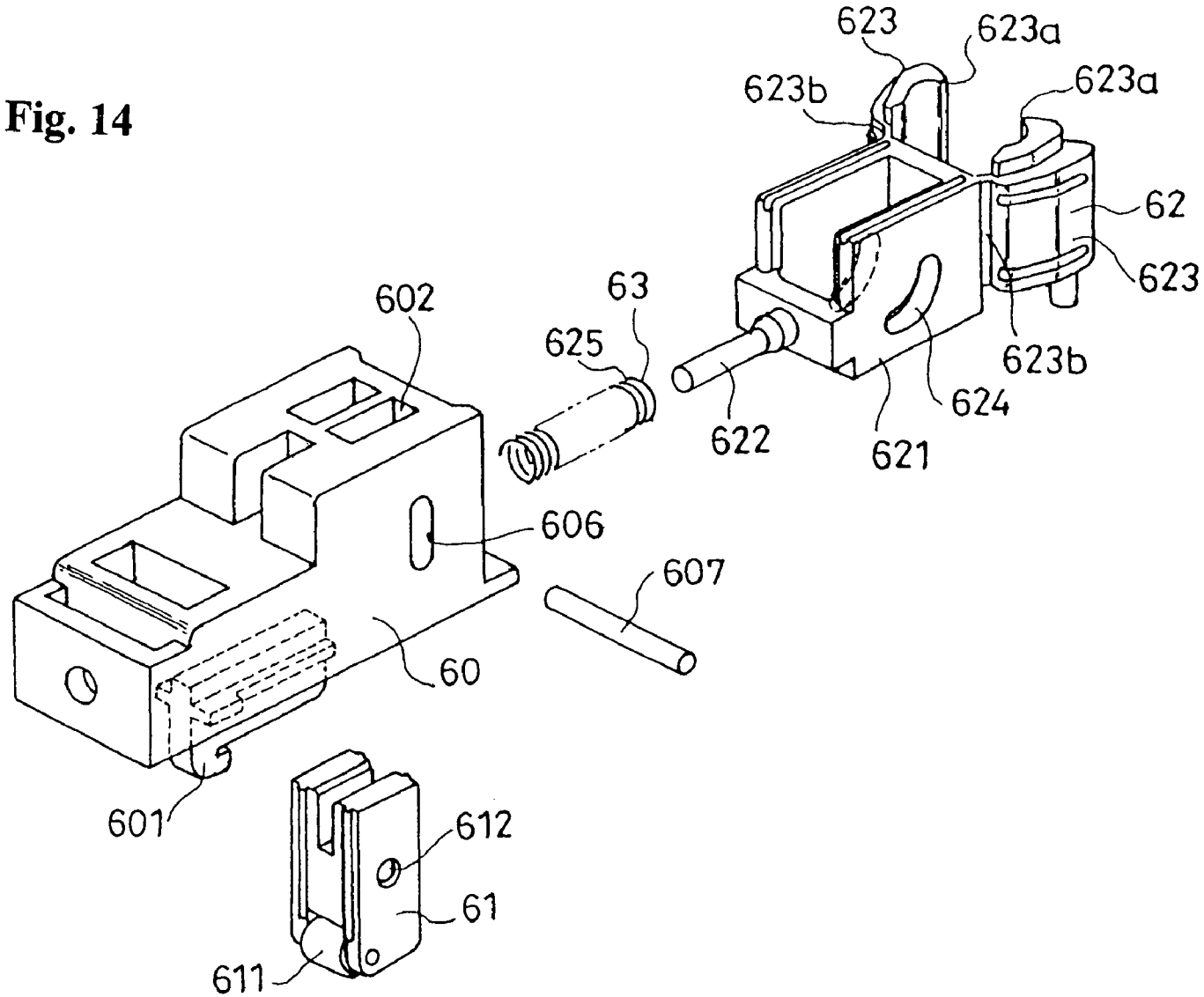
FIG. 14 is an exploded perspective view of a catcher.
Figure 15:
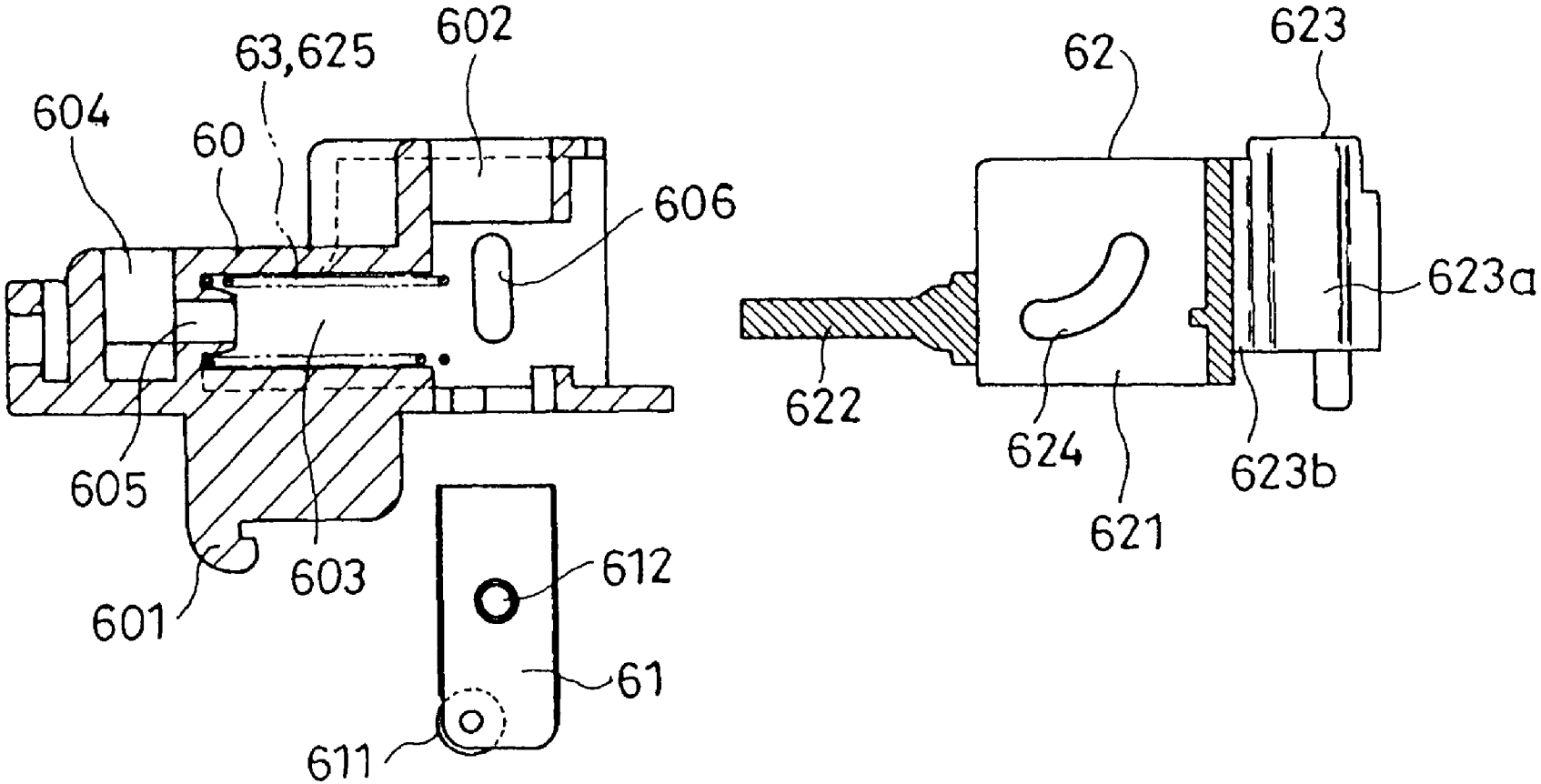
FIG. 15 is an exploded sectional structural view of the same.
Figure 16:
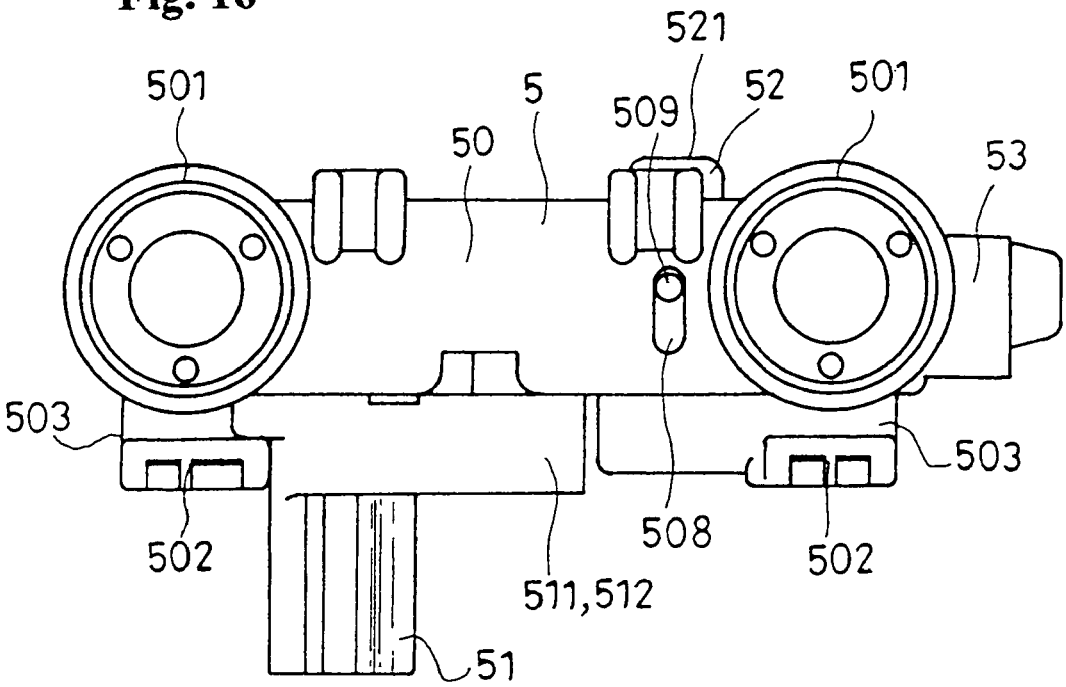
FIG. 16 is a front view of the runner.
Figure 17:
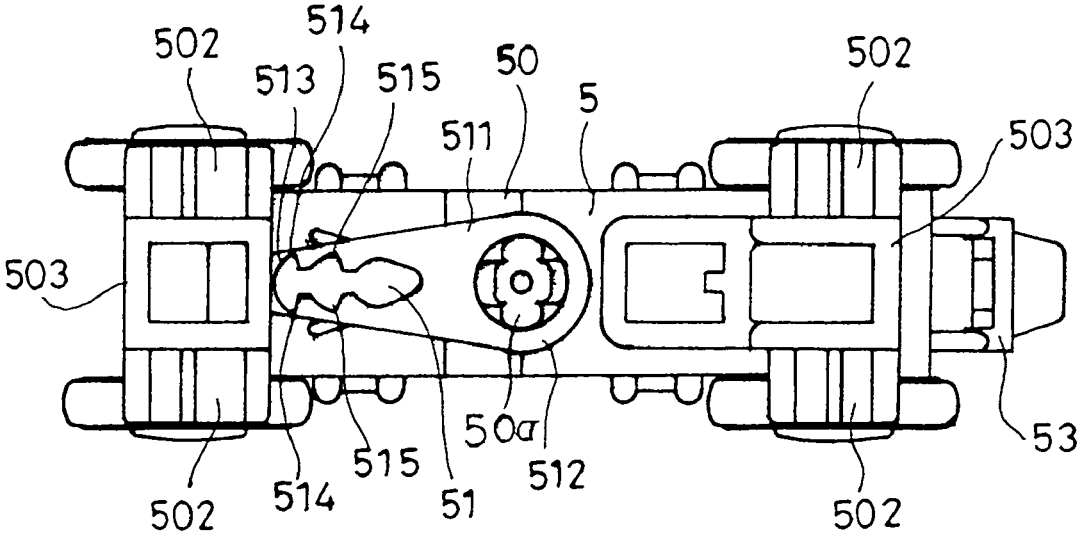
FIG. 17 is a bottom plan view of the same.

Also, FIGS. 14, 15 respectively show a state wherein each member comprising a catcher 6 of the self-propelled forward movement mechanism is separated. Also, FIGS. 16, 17 respectively show the runner 5 of the self-propelled forward movement mechanism.

Figure 18:
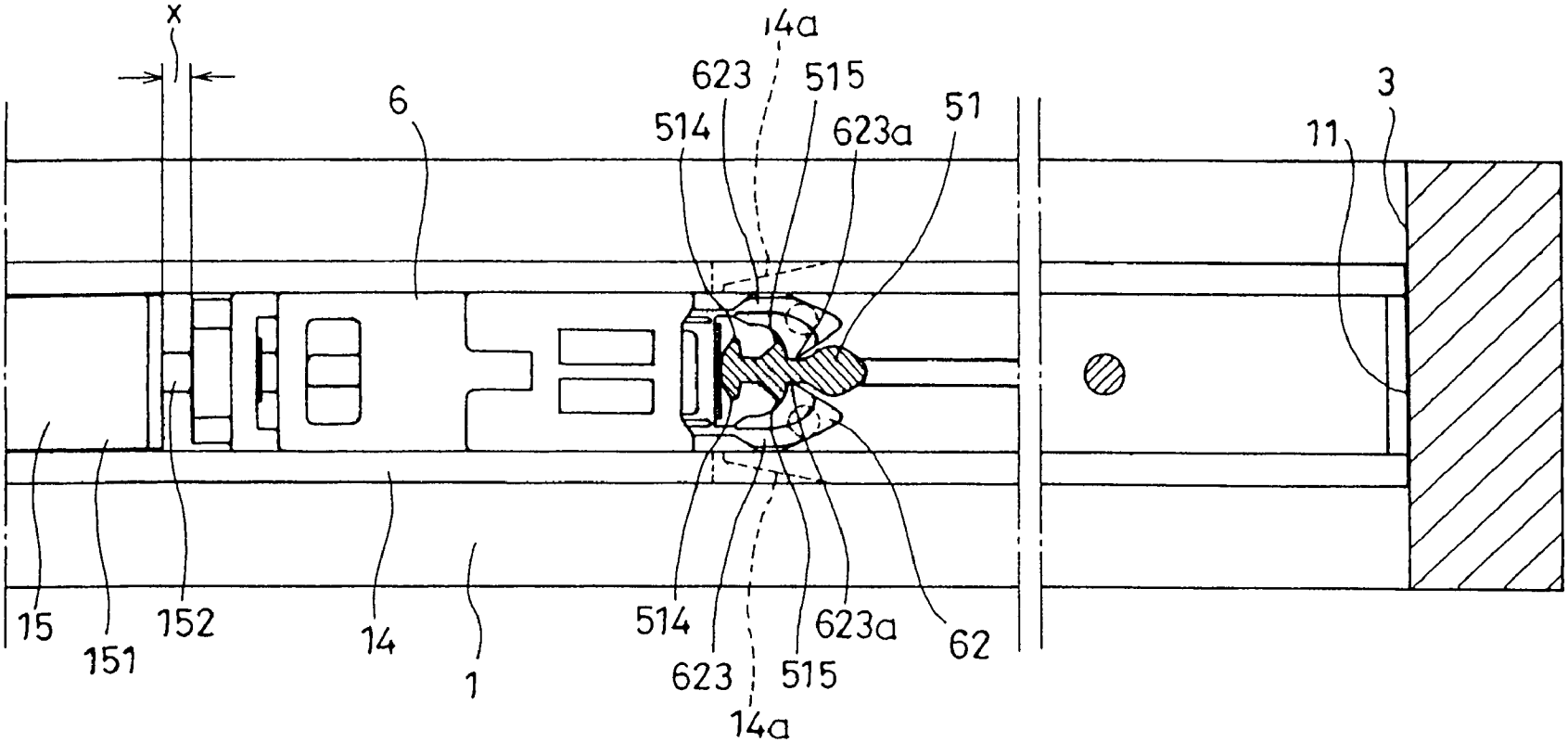
FIG. 18 is an enlarged plan view of the essential part of the self-propelled forward movement mechanism.
Figure 19:
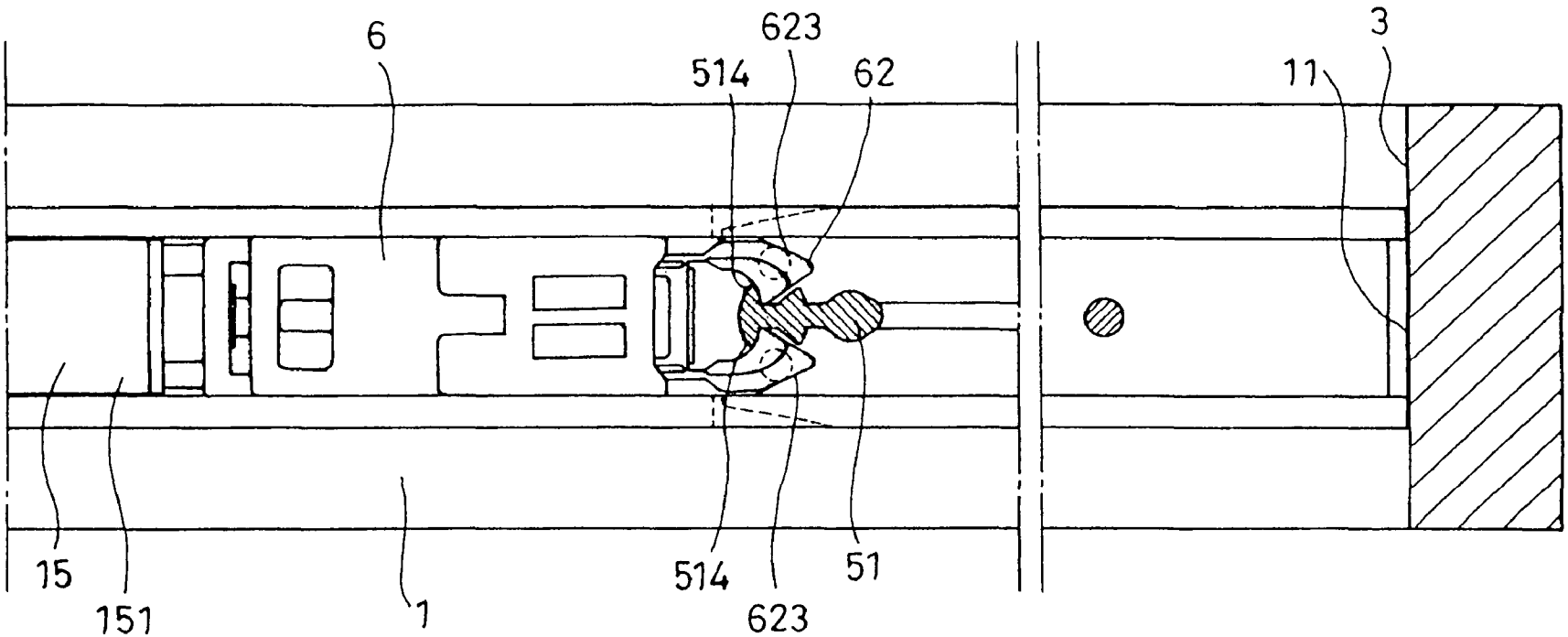
FIG. 19 is an enlarged plan view of the essential part of the self-propelled forward movement mechanism.

Moreover, FIG. 18 shows an example which prevents from causing a space between the front end 11 and an end face 3 such as a door stop when the movable body 1 is in the stop position SP. Also, in an example of FIG. 18, in the case that the catcher 6 has happened to be moved back with an urging force of an urging means 7 due to an operational error in a state wherein the catcher 6 does not capture a striker 51, FIG. 19 shows a state wherein the movable body 1 is moved forward to the stop position SP so that the striker 51 is engaged with the catcher 6 which has been moved back in the above-mentioned manner.

The self-propelled forward movement mechanism according to an embodiment moves the movable body 1 whose upper portion is hung from the rail 2 and supported, forward to the stop position SP by self propulsion after the movable body 1 has been moved forward to the self-propelling start position SA. For this kind of movable body 1, typically, an overhung door 1' which is hung from the rail 2 and supported by a hanging wheel 10, a folding door and the like are expected.

After the overhung door 1' which is supported by the rail 2 to be movable along the rail 2 and the like has been manually traveled forward to the above-mentioned self-propelling start position SA, the above-mentioned mechanism is used in such a way as to move forward by self propulsion to the stop position SP, i.e., typically, a position wherein the end face (the front end 11) positioned in front of the forward movement of the overhung door 1' bumps into the door stop or the end face 3 of the overhung door which is the counterpart.

The mechanism includes (1) the runner 5, (2) the catcher 6, and (3) the urging means 7 of the catcher 6.

The runner 5 is combined with the rail 2 to be travelable, at the same time, engaged with a rail 2 at the above-mentioned self-propelling start position SA, and the lower part thereof includes the striker 51.

The catcher 6 is positioned at the back of the striker 51 in the upper part of the movable body 1; housed to be movable along a moving direction of the movable body 1; and structured in such a way as to be engaged with a movable body 1 in a reference position R.

The urging means 7 is structured in such a way as to store an urging force when the catcher 6 is in the reference position R.

In the self-propelling start position of the movable body 1, the catcher 6 in the reference position R captures the striker 51 of the runner 5 which has come to a stop by being engaged with the rail 2, and at the same time, due to this capture, the engagement between the catcher 6 and the movable body 1 is released, the urging force of the urging means 7 is released, and due to the backward movement of the movable body 1 from the stop position to the self-propelling start position, the catcher 6 is positioned in the reference position R again and at the same time, the striker 51 of the runner 5 is released, and the engagement between the runner 5 and the rail 2 can be subsequently released.

In the previous stage that the movable body 1 is moved forward to the self-propelling start position SA, the catcher 6 is in the reference position, and engaged with the movable body 1. When the movable body 1 is moved forward to the self-propelling start position SA, the runner 5 is engaged with the rail 2 and comes to a stop, at the same time, the catcher 6 captures the striker 51 of the runner 5 and the catcher 6 is integrated into the runner 5 which has come to a stop. At the same time, the engagement between the catcher 6 and the movable body 1 is released. Due to the release of this engagement, a stored force of the urging means 7 can be released, so that the movable body 1 can be moved by self propulsion to the stop position SP. When the movable body 1 which was moved forward to the stop position SP by self propulsion is moved backward to the self-propelling start position SA, the catcher 6 is relatively moved to the reference position while storing an urging force to the urging means 7; engaged with the movable body 1 again; and also releases the striker 51. After this, the engagement between the runner 5 and the rail 2 is released. Herewith, the movable body 1 tries to return to the previous stage wherein the movable body 1 is moved forward to the self-propelling start position S wherein the runner 5 and the catcher 6 are separated, and also with the movement of the movable body 1, the runner 5 also travels along the rail 2.

The runner 5 is assembled to the rail 2 to be travelable. This kind of runner 5 includes a runner main body 50 which can be roughly housed inside the rail 2; and the striker 51 projecting downwardly from the runner main body 50, entered into the concave 12 described hereinafter, and positioned in front (between the catcher 6 and the front end 11 of the movable body 1) of the catcher 6 which is located inside the concave 12.

Also, this kind of runner main body 50 is provided with a runner stopper 52 retractably projecting the outer end 521 from the side portion of the runner main body 50, and always leaving a space S between the outer end 521 and the inner surface 202 of the rail 2. In an example shown in the figures, this kind of runner stopper 52 is assembled to the runner main body 50 to be movable upward and downward, and structured such that the upper end is retractably projected from the upper part of the runner main body 50 by an urging force. This kind of outer end 521 of the runner stopper 52 never contacts the inner surface 202 of the rail 2 due to the above-mentioned space S, so that the runner stopper 52 does not create resistance to the travel of the runner 5 accompanied by the forward movement of the movable body 1 to reach the above-mentioned self-propelling start position SA, and also accompanied by the backward movement of the movable body 1 from the self-propelling start position SA. Also, the runner stopper 52 does not generate noise by this movement. The direction of the projection of the runner stopper 52 is decided based on the relationship with a formed position of an engagement portion 24 of the rail 2 described hereinafter, and can be different from the example shown in the figures such that the runner stopper 52 may be provided in the runner main body 50 so as to be retractable in a parallel direction or an oblique direction.

In the example shown in the figures, the rail 2 is structured in such a way as to have an upper plate portion 20; right and left plate portions 21, 21; and flexed plate portions 22 projecting to the inside from respective lower ends of the right and left plate portions 21, 21. (FIG. 13) This kind of rail 2 is attached to a ceiling 4 by being inserted into a groove 40 formed in the ceiling 4 with the upper plate portion 20 up. The runner main body 50 is structured to extend in a length direction of the rail 2, and also in the front and back thereof, the runner main body 50 includes wheels 501 which rotate with wheels respectively arranged horizontally on the outside of right and left side portions. The runner main body 50 is housed inside the rail 2 in such a way that the left-side wheel 501 travels on the inner face of the flexed plate portion 22 of the left plate portion 21 of the rail 2, and the right-side wheel 501 travels on the inner face of the flexed plate portion 22 of the right plate portion 21 of the rail 2, respectively.

Also, the runner main body 50 is provided with postural retaining portions 502 projecting downwardly through an opening 23 formed in the lower portion of the rail 2 and ranging the length direction of the rail 2, and located under the outer face of the lower portion of the rail 2. In the example shown in the figures, protruding portions 503 which respectively protrude downwardly from the above-mentioned opening 23 to the lower portions of the front and back of the runner main body 50, are provided. Also, the postural retaining portions 502 are formed in a shape of a piece projecting in a horizontal direction respectively on both right and left sides of the protruding portions 503. A pitch between the upper face of the postural retaining portion 502 and the lower end of the wheel 501 is set to be approximately an equal thickness with that of the flexed plate portion 22. (FIG. 13)

Herewith, in this example, with the forward movement to reach the above-mentioned self-propelling start position SA of the movable body 1, and also with the backward movement of the movable body 1 from the self-propelling start position SA, the runner 5 can be smoothly traveled along the rail 2. Also, the above-mentioned postural retaining portions 502 can prevent the traveling runner 5 from leaning downwardly on the front side thereof or from leaning downwardly on the back side thereof during the travel of the runner 5, and help the runner 5 to travel further smoothly. At the same time, when the movable body 1 is moved forward to the self-propelling start position SA, the postural retaining portions 502 help the striker 51 advance into retaining bodies 62 of the catcher 6 described hereinafter without leaning so that the striker 51 can be retained reliably in the retaining bodies 62.

The striker 51 is provided between the protruding portions 503 in two portions of the lower portion of the above-mentioned runner main body 50. The striker 51 is provided in such a way as to project downwardly from a back end portion 513 of a striker base 511 assembled to the runner main body 50 to be rotatable-around a center of an axial projection 50*a* by fitting the axial projection 50*a* formed at the bottom portion of the runner main body 50 into an axial bore 512*a* formed in the front end portion 512. In the example shown in the figures, this kind of striker 51 is provided with an engagement portion relative to the retaining bodies 62 in two portions or more by providing a space along the moving direction of the movable body 1. Specifically, in the example shown in the figures, this kind of striker 51 is provided with engagement groove portions which extend in a longitudinal direction with two pieces respectively on both right and left sides. Herewith, this kind of striker 51 is provided with first engagement tooth portions 514 respectively projecting to both right and left sides on the back side (the backward movement side of the movable body 1) in a horizontal cross section; and second engagement tooth portions 515 provided on the front side by providing a space with the first engagement tooth portions 514. When the striker 51 is deeply entered into the retaining bodies 62, overhanging portions 623*a* of retaining pieces 623 of the retaining bodies 62 of the catcher 6 described hereinafter are engaged with the second engagement tooth portions 515. Also, when the striker 51 is shallowly entered into the retaining bodies 62, the overhanging portions 623*a* of retaining pieces 623 of the retaining bodies 62 of the catcher 6 described hereinafter are engaged with the first engagement tooth portions 514.

Incidentally, as shown in FIG. 18, when the movable body 1 is in the stop position SP, in order not to create a space between the front end 11 and the end face 3 such as the door stop, an urging force of the urging means 7 may be applied to the movable body 1 in the stop position SP by forming a space x between the back end of the catcher 6 and the front end of a cylinder 151 in a state wherein a piston rod 152 is not completely entered into the cylinder 151 of a damper device 15 described hereinafter. In this case, when the movable body 1 is in the stop position SP, the overhanging portions 623*a* of the retaining pieces 623 of the retaining bodies 62 of the catcher 6 are engaged with the second engagement tooth portions 515 of the striker 51, and also, a pitch between the above-mentioned first engagement tooth portion 514 and the second engagement tooth portion 515 of the striker 51 is set to have approximately an equal size with that of the space x. Hereby, in the example in FIG. 18, in a state wherein the movable body 1 is in a position not reaching the self-propelling start position SA, in the case that a catcher stopper 61 has been slipped out of a concave 146 and the catcher 6 has happened to be moved back by an urging force of the urging means 7 after the retaining bodies 62 of the catcher 6 were mistakenly pushed in, the movable body 1 is moved forward to the stop position SP, so that the overhanging portions 623*a* of the retaining pieces 623 of the retaining bodies 62 of the catcher 6 are engaged with the first engagement tooth portion 514 of the striker 51. (FIG. 19) After this, the movable body 1 is moved backward, so that it can be back again in a desired state, i.e. in the stop position SP, the space x is formed between the back end of the catcher 6 and the front end of the cylinder 151, so that the urging force of the urging means 7 can be operated to the movable body 1 in the stop position SP. In the example in FIG. 18, in the position wherein the catcher 6 has been moved back completely, one portions 14*a* of right and left side walls of cases 14 located outside the retaining pieces 623 of the retaining bodies 62 are structured to be elastically transformable, hereby, at the time of the above-mentioned operational error, when the movable body 1 is moved forward to the stop position SP, the retaining pieces 623 receiving the striker 51 can be elastically transformed.

Also, the right and left positions of the striker 51 can be moved in a certain range by the above-mentioned assembly of the runner main body 50 and the striker base 511, so that even if there occurred any deviation in a supporting position of the movable body 1 and the like with time, the position of the striker 51 can be corrected through the bumping toward the retaining bodies 62 accompanied with the forward movement of the movable body 1 in such a way as to be received by the retaining bodies 62.

Also, on the front end side of the runner main body 50, a vertically-facing operating bore 504 penetrating the runner main body 50 in the up-and-down direction is formed. Also, in the runner main body 50, a laterally-facing operating bore 505 providing a bore opening in the front end, continuing toward the back end side, and communicating with the vertically-facing operating bore 504 in an intersecting manner, is formed. In the inner back portion of the laterally-facing operating bore 505, a through-bore 507 communicating with an escape void 506 is formed.

In this embodiment, additionally, in the runner main body 50 of the runner 5, a release part 53 assembled to be movable back and forth; projecting the front end to the forward movement end which always becomes the front due to an urging force; and moving the runner stopper 52 downwardly by being pushed in against this urging force, is provided.

In the example shown in the figures, the runner stopper 52 is structured in such a way as to form an axis with a pin through-bore 522 penetrating in the right-and-left direction in the intermediate portion, and the upper end which becomes the outer end thereof is retracted from the bore opening on the upper side of the vertically-facing operating bore 504.

On the other hand, the release part 53 includes rectangular frame portions 531 opening on the top and bottom; and an axial portion 532 projecting backward from the back end of the rectangular frame portions 531. In the right and left frame plates of the rectangular frame portions 531, curved guide grooves 533 whose lower end of the groove is positioned in front; upper end of the groove is positioned at the back; and oblique upper front is the outside of the curve, are formed and penetrated, respectively.

Also, vertical guide grooves 508 are respectively formed and penetrated on both right and left end portions of the portion wherein the laterally-facing operating bore 505 and the vertically-facing operating bore 504 intersect in the runner main body 50.

In the example shown in the figures, the release part 53 is entered into the laterally-facing operating bore 505 with the axial portion 532 as the front, and also the runner stopper 52 is entered into the rectangular frame portions 531 of the release part 53 through the vertically-facing operating bore 504. In this state, a pin 509 is penetrated into each vertical guide grooves 508, 508; each curved guide grooves 533, 533; and the pin through-bore 522, and the runner stopper 52 and the release part 53 are assembled to the runner main body 50. Also, in the axial portion 532 of the release part 53, a compression coil spring 534 is wound around as an urging body, and this compression coil spring 534 always presses the back end of the spring against the inner back portion of the laterally-facing operating bore 505, and always presses the front end of the spring against the back end of the rectangular frame portions 531.

Due to this compression coil spring 534, the release part 53 is always urged forward, and through the release part 53 urged in the above-mentioned manner, the runner stopper 52 is always urged upwardly.

Figure 10:
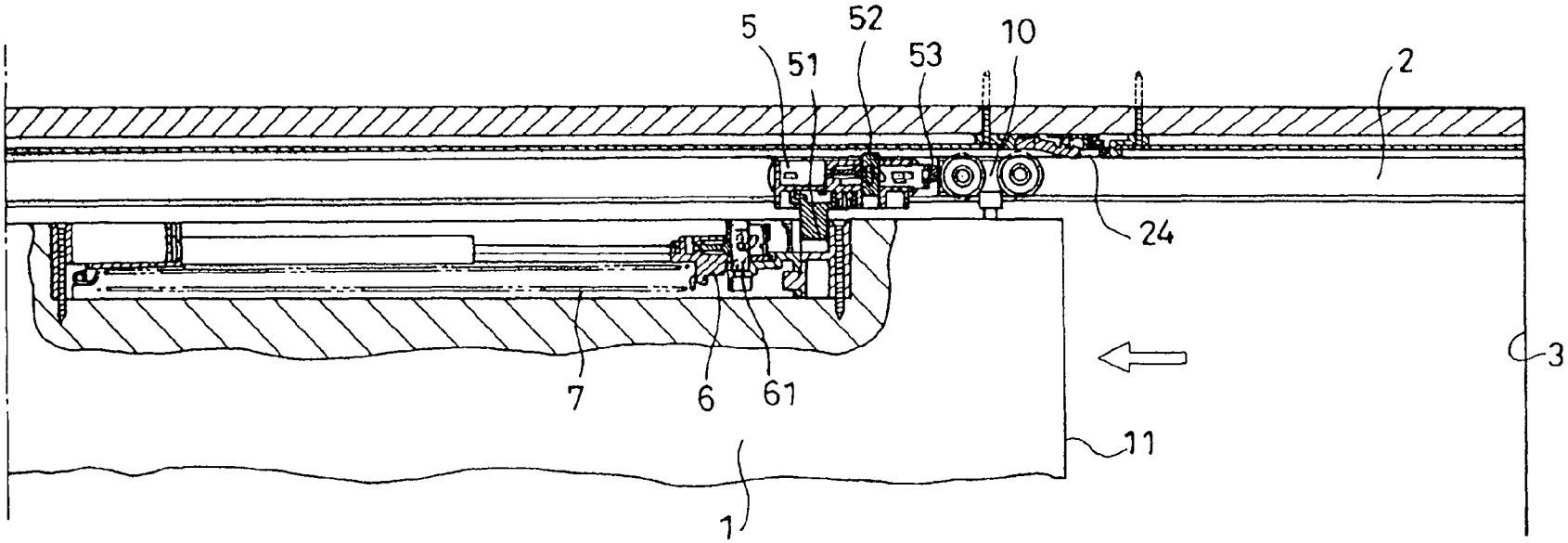
FIG. 10 is a partially sectional front structural view of the essential part of the self-propelled forward movement mechanism.
Figure 11:
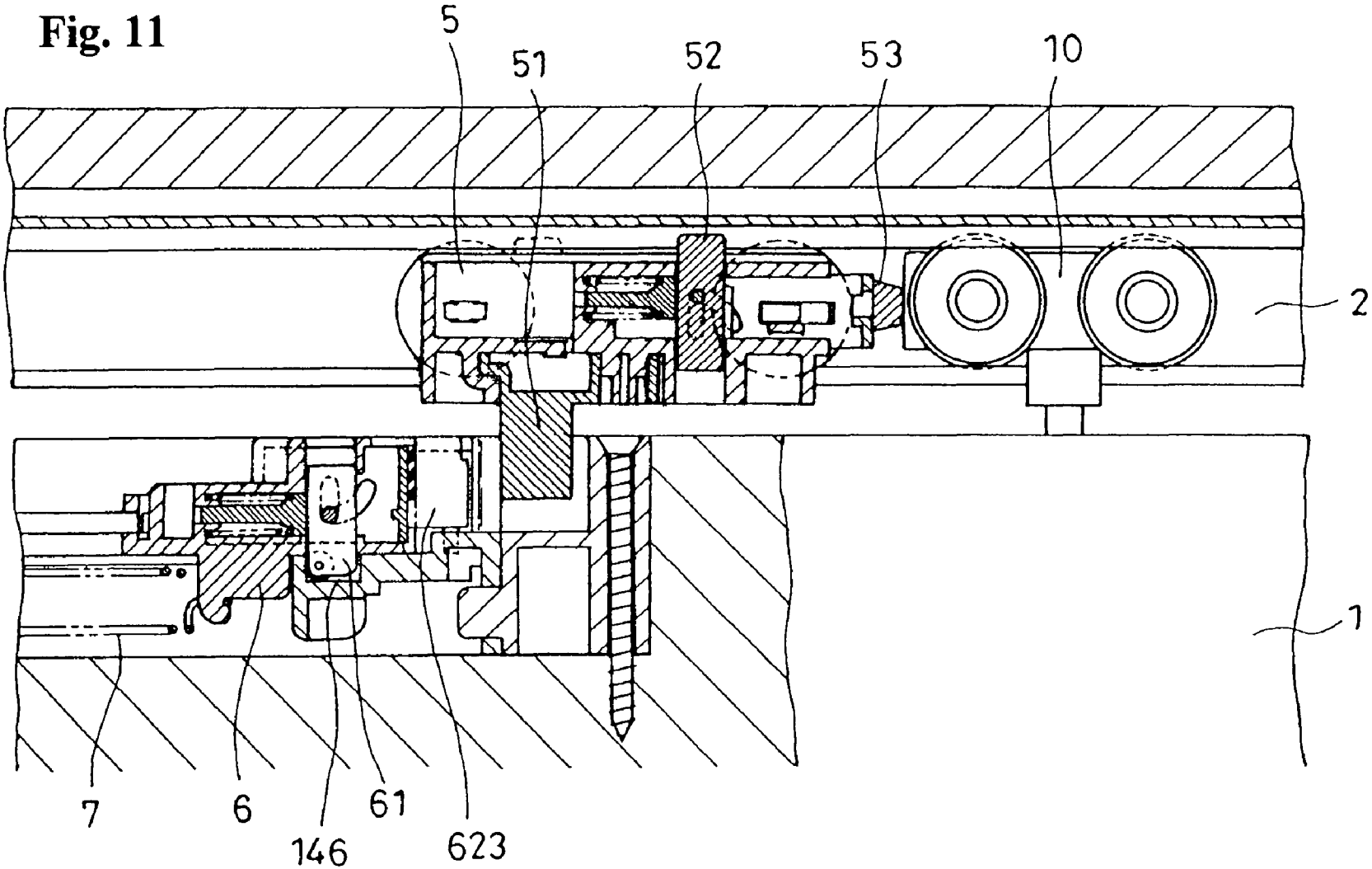
FIG. 11 is an enlarged view of the essential part in FIG. 10.
Figure 12:
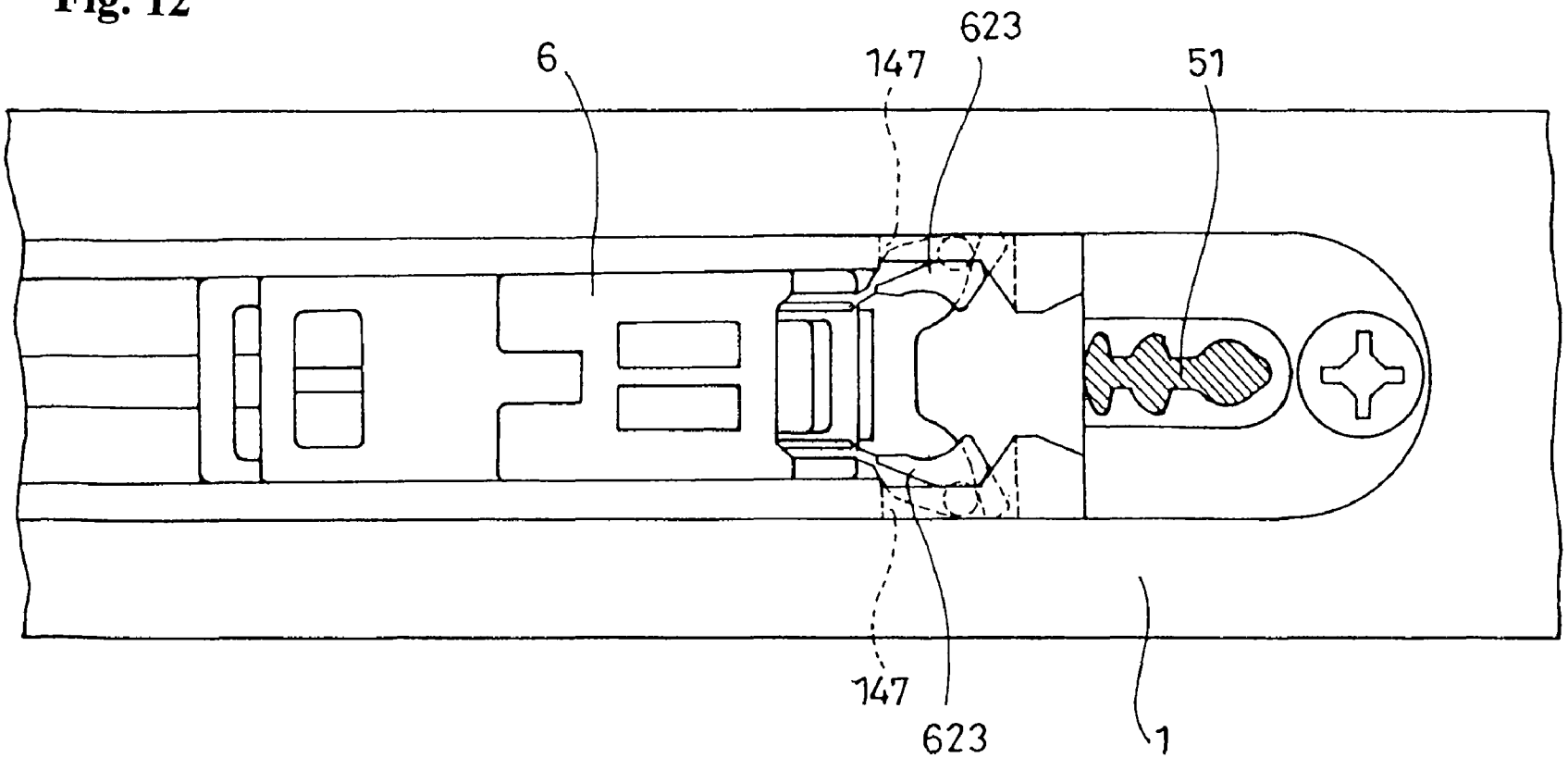
FIG. 12 is an enlarged plan view of the essential part in a state of FIG. 10.

In the previous stage wherein the movable body 1 is moved forward to the self-propelling start position SA, the release part 53 is most projected at the front. Hereby, the pin 509 is positioned in the upper end of the groove of the vertical guide grooves 508 and the in the upper end of the groove of the curved guide grooves 533, and the runner stopper 52 projects the outer end thereof from the side portion of the runner main body. In the example shown in the figures, the engagement portion 24 of the rail 2 described hereinafter is provided with a first portion 242 which is positioned on a backward movement side of the movable body 1 formed in the upper plate portion 20 of the rail 2 and also retractably projected due to an urging force; and a second portion 243 which is located on a forward movement end side. Also, the engagement portion 24 is structured in such a way as to receive the outer end 521 of the runner stopper 52 between both portions 242, 243 and engaged with the outer end 521. On a side wherein the first portion 242 faces backward, an inclined surface 542*c* gradually projecting downwardly as the inclined surface 542*c* goes forward (the forward movement end side of the movable body 1), is formed. When the movable body 1 is moved forward to the self-propelling start position SA, the runner stopper 52 of the runner 5 which has been moved forward together with the movable body 1 by being pushed by the retaining bodies 62 of the catcher 6 housed in the concave 12 described hereinafter of the movable body 1, bumps into the inclined surface 242*c* of the first portion 242. Due to this bumping, the first portion 242 is retracted against the above-mentioned urging force, and in a position wherein the runner stopper 52 goes beyond the first portion 242, due to this urging force, the first portion 242 is protruded again, and the runner stopper 52 is engaged and held between the first portion 242 and the second portion 243. (FIG. 5) Hereby, the runner 5 has come to a stop. Also, when the movable body 1 which has been moved forward to the stop position SP by self propulsion is moved backward to the self-propelling start position SA, (FIG. 6 to FIG. 9) as described hereinafter, the hanging wheel 10 is pressed into the release part 53 in the runner 5 which has come to a stop as mentioned before from the front, and the release part 53 is moved backward against the above-mentioned urging force. The backward movement of the release part 53 can be possible by putting the above-mentioned axial portion 532 into the escape void 506 through the above-mentioned through-bore 507. When the release part 53 is moved backward, the pin 509 is guided to the groove lower end of the curved guide grooves 533, so that due to the backward movement of the release part 53, the runner stopper 52 is retracted downwardly, and slipped out of an engagement portion 241, and the runner 5 is also moved backward together with the backward movement of the movable body 1. (FIG. 10)

On the other hand, the catcher 6 is housed to be movable along the moving direction inside the concave 12 which continues along the moving direction of the movable body 1 formed in the upper part of the movable body 1.

In the example shown in the figures, the hanging wheel 10 is provided in the upper portion on a front end 11 side of the overhung door 1' as the movable body 1. Also, a built-in concave 13 of the case 14 which opens upward and continues in the moving direction of the overhung door 1' is formed in the upper part of the overhung door 1' having a slight space with the hanging wheel 10. In the example shown in the figures, the case 14 with an open upper face is entered into the built-in concave 13; houses the catcher 6 in this case 14 to be movable in the length direction of this case 14; and provides the catcher 6 on an overhung door 1'. More specifically, in the example shown in the figures, the inside of the above-mentioned case 14 is structured to function as the above-mentioned concave 12.

The case 14 is divided approximately into top and bottom portions by a dividing member 141 formed in the position of the approximately middle of the up-and-down direction. In the dividing member 141 between the front end side of the case 14 and the intermediate portion, a slot 142 is formed in the position of approximately in the middle of the width direction. A hook portion 601 formed in the back end of a catcher main body 60 described hereinafter of the catcher 6 is structured to be able to enter into a lower portion chamber 143 of the case 14 through the slot 142. Inside this lower portion chamber 143, a tension coil spring 145 whose front end of the spring is attached to the above-mentioned hook portion 601 of the catcher main body 60, and whose back end of the spring is attached to a hook portion 144 formed in the back end of the case 14, is housed. Also, the concave 146 facing downwardly is formed in the dividing member 141 which is placed between the front end of the slot 142 and the front end of the case 14. The tension coil spring 145 is stretched the most in the reference position R of the catcher 6 wherein the hereinafter-described catcher stopper 61 is entered into the concave 146. More specifically, in the example shown in the figures, the concave 146 functions as the engagement portion of the catcher stopper 61. Also, right and left side walls of the case 14 are notched between the engagement portion and the front end of the case 14, and the retaining pieces 623 of the retaining bodies 62 described hereinafter of the catcher 6 in the reference position R are entered into notch portions 147, and become a non-retaining state. (FIG. 3)

This kind of catcher 6 includes the catcher stopper 61 provided to be movable up and down relative to the catcher main body 60; the retaining bodies 62 of the striker 51 provided to be movable backward and forward, and also receiving the striker 51 from the front in the non-retaining state; and urging bodies for these. Due to the urging bodies, when the catcher stopper 61 is projecting the lower end downwardly, the retaining bodies 62 are in an advanced position and in the non-retaining state, and also when the retaining bodies 62 are in a backward position and in a retaining state, the catcher stopper 61 pulls the lower end in upwardly.

In the example shown in the figures, this kind of catcher main body 60 is structured in such a way as to be long in the moving direction of the movable body 1 and housed within the width of a upper portion chamber 148 of the case 14. The hook portion 601 is formed in the lower portion of the back end side of the catcher main body 60.

On the front end side of the catcher main body 60, a vertically-facing operating bore 602 penetrating in the up-and-down direction is formed. Also, in the catcher main body 60, a laterally-facing operating bore 603 providing a bore opening in the front end, continuing toward the back end side of the catcher main body 60, and communicating with the vertically-facing operating bore 602 in an intersecting manner, is formed. An escape void 604 is formed between the inner back portion of the laterally-facing operating bore 603 and the back end of the catcher main body 60. Also, a through-bore 605 communicating with the escape void 604 is formed in the inner back portion of the laterally-facing operating bore 603.

In the example shown in the figures, the catcher stopper 61 is structured in such a way as to include a roller 611 on the lower end; form an axis with a pin through-bore 612 penetrating in the right-and-left direction in the intermediate portion; and retract the lower end from the bore opening of the lower side of the vertically-facing operating bore 602. The projecting direction of this catcher stopper 61 is decided based on the relationship with a formation position of the engagement portion (concave 146) of the concave 12. This projecting direction may differ from the example shown in the figures, and the catcher stopper 61 may be provided in the catcher main body 60 to be retractable in a horizontal direction or an oblique direction.

On the other hand, the retaining bodies 62 includes a rectangular frame portion 621 opening on the top and bottom; an axial portion 622 projecting backward from the back end of the rectangular frame portion 621; and a pair of retaining pieces 623, 623 provided in the front end of the rectangular frame portion 621. The pair of retaining pieces 623, 623 includes the overhanging portions 623*a* projecting inward on the side wherein the retaining pieces 623, 623 face to each other. Also, the pair of retaining pieces 623, 623 is respectively integrated into the rectangular frame portion 621 through a resin hinge portion 623*b* elastically transformable, and due to the elasticity of the resin hinge portion 623*b*, a distance between top portions of the above-mentioned overhanging portions 623*a* can be positioned in the non-retaining state which is larger than the width of the striker 51 of the runner 5. Also, in the right and left frame plates of the rectangular frame portion 621, a curved guide groove 624 whose upper end of the groove is positioned in front; whose lower end of the groove is positioned at the back; and whose oblique lower front is the outside of the curve, is penetratingly formed, respectively.

Also, vertical guide grooves 606 are respectively penetratingly formed on both right and left end portions of the portion wherein the laterally-facing operating bore 603 and the vertically-facing operating bore 602 intersect in the catcher main body 60.

In the example shown in the figures, the retaining bodies 62 enter into the laterally-facing operating bore 603 with the axial portion 622 as the front, and also the catcher stopper 61 enters into the rectangular frame portion 621 of the retaining bodies 62 through the vertically-facing operating bore 602. In this state, a pin 607 penetrates into each vertical guide grooves 606, 606; each curved guide grooves 624, 624; and the pin through-bore 612, and the catcher stopper 61 and the retaining bodies 62 are assembled to the catcher main body 60. Also, in the axial portion 622 of the retaining bodies 62, a compression coil spring 625 is wound around, and this compression coil spring 625 always presses the back end of the spring against the inner back portion of the laterally-facing operating bore 603, and always presses the front end of the spring against the back end of the rectangular frame portion 621.

Due to this compression coil spring 625, the retaining bodies 62 are always urged forward, and through the retaining bodies 62 urged in the above-mentioned manner, the catcher stopper 61 is always urged downwardly. More specifically, in the example shown in the figures, the above-mentioned compression coil spring 625 has a function as an urging body.

In the previous stage wherein the movable body 1 is moved forward to the self-propelling start position SA, the retaining bodies 62 are projected to the most front. Hereby, the above-mentioned pin 607 is positioned in the lower end of the groove of the vertical guide grooves 606 and in the lower end of the groove of the curved guide grooves 624, and the catcher stopper 61 puts the lower end thereof into the engagement portion. (FIG. 1, the reference position R of the catcher 6) When the movable body 1 is moved forward toward the self-propelling start position SA, the striker 51 of the runner 5 advances between the pair of the retaining pieces 623, 623 of the retaining bodies 62 which are in the non-retaining state and hits into the front end of the rectangular frame portion 621. When the runner stopper 52 of the runner 5 is engaged with the engagement portion 24 of the rail 2 and the runner 5 comes to a stop, the retaining bodies 62 is pressed by the striker 51 and moved backward against an urging force of the above-described urging body. (FIGS. 5 to 7) The backward movement of the retaining bodies 62 can be possible by putting the above-mentioned axial portion 622 into the escape void 604 through the above-mentioned through-bore 605. When the retaining bodies 62 are moved backward, the retaining pieces 623 are slipped out of the notch portions 148 of the case 14. While the resin hinge portion 623*b* is elastically transformed due to the right and left side walls of the case 14, the pair of the retaining pieces 623, 623 is positioned in a retaining state wherein a distance between top portions of the above-mentioned overhanging portions 623*a* is made smaller than the width of the striker 51 of the runner 5. (FIG. 8) Hereby, the catcher 6 is integrated into the runner 5 which has come to a stop. Also, at the same time, since the pin 607 is guided to the groove upper end of the curved guide groove 624 due to the backward movement of the retaining bodies 62, the catcher stopper 61 is moved upwardly, and slipped out of the concave 146 as the engagement portion provided in the case 14. As mentioned above, when the engagement between the catcher stopper 61 and the engagement portion (concave 146) of the case 14 is released, the elasticity in a direction wherein the tension coil spring 145 shrinks can be returned, so that the movable body 1 is moved to the stop position SP by self propulsion due to this elasticity return. (FIG. 6) In the time of this self-propelled movement, the roller 611 of the catcher stopper 61 is contacted with the upper surface of the dividing member 141 of the case 14 and rotated, and when the self-propelled forward movement is completed, the catcher 6 is relatively moved backward to the position of the approximately middle of the length direction of the case 14.

In this embodiment, the hanging wheel 10 is provided between the front end 11 of the movable body 1 and the concave 12, and when the movable body 1 in the stop position SP is moved backward, the hanging wheel 10 hits the release part 53, so that the hanging wheel 10 pushes in as mentioned above.

More specifically, due to the backward movement of the movable body 1 from the stop position SP, the hanging wheel 10 bumps into the runner 5 wherein a main body 101 of the hanging wheel 10 has come to a stop in the rail 2 from the front.

Herewith, in this embodiment, by moving the movable body 1 in the stop position SP backward to the self-propelling start position SA, the engagement between the runner stopper 52 and the engagement portion 24 of the rail 2 can be released. Hereby, the runner 5 can be moved backward to an approximate position along the rail 2 together with the movable body 1.

Incidentally, due to the backward movement of the movable body 1 from the stop position SP, the catcher 6 integrated into the runner 5 which has come to a stop is moved relatively forward while storing an urging force to the urging means 7, and in the stage wherein the movable body 1 has reached the self-propelling start position SA, the catcher 6 puts the catcher stopper 61 into the engagement portion (concave 146) of the case 14 due to an urging force of the urging body again and engages between the engagement portion and the catcher stopper 61. (FIG. 9) At the same time, due to an urging force of the urging body, the retaining bodies 62 can be advanced, so that the retaining bodies 62 are returned to the non-retaining state, and the catcher 6 and the striker 51 are separated. (FIGS. 11, 12) Herewith, the initial state can be reinstated.

Also, in the embodiment, the damper device 15 which applies brake for relative movement of the catcher 6 is built in the above-mentioned concave 12.

In the example shown in the figures, the damper device 15 is provided with the cylinder 151 in the upper portion chamber 148 of the above-mentioned case 14 and a piston (not shown); structured so as to provide a resistance when the piston is advanced into the cylinder 151; and housed. In the example shown in the figures, the back end of the cylinder 151 is attached to the back end of the case 14, and also the front end of the piston rod 152 is attached to the back end of the catcher 6, and in the reference position R of the catcher 6, the piston rod 152 is positioned to project the most from the inside of the cylinder 151. Incidentally, in the example shown in the figures, the position wherein the piston rod 152 is entered into the cylinder 151 to a maximum extent is set as a limit position of the relative backward movement of the catcher 6.

Herewith, in the embodiment, by appropriately easing up the urging force of the relative movement of the catcher 6 by the self-propelled forward movement of the movable body 1 after the self-propelling start position SA, a high-quality feeling can be provided for the self-propelled movement of the movable body 1. Also, the collision noise at the time when the movable body 1 comes to a stop can be reduced.

The engagement portion 24 of the rail 2 includes an attachment base 241; the first portion 242 having back end 242*b* assembled to this attachment base 241 to be rotatable and front end 242*a* obliquely projected from a bore formed in the lower portion of the attachment base 241, the first portion 242 being forced downwardly by a compression coil spring 244 which is equipped among the back end 242*b* and the front end 242*a* and a ceiling portion of the attachment base 241; and the second portion 243 which projects downwardly from the attachment base 241 in such a way as to form a space in front and the back side between the front end of the first portion 242 and the second portion 243. In the example shown in the figures, the attachment base 241 is attached in such a way that the first portion 242 and the second portion 243 project into the rail 2 from the attachment bore 201 opened in the upper plate portion 20 on the outer face of the upper plate portion 20 of the rail 2, so that the engagement portion 24 is formed in the rail 2.

Incidentally, all the contents of specifications, scopes of claims, drawings, and abstracts of Japanese Patent Applications No. 2006-323409 filed on Nov. 30, 2006 and No. 2007-101630 filed on Apr. 9, 2007, are cited herein, and incorporated in the specification of the present invention.

What is claimed is:

1. A self-propelled forward movement mechanism for moving a movable body having an upper portion supported by a rail forward by self propulsion to a stop position after the movable body is moved forward to a self-propelling start position, comprising:

a runner movably attached to the rail, engaged with the rail in the self-propelling start position, and having a striker in a lower portion;

a catcher corresponding to the striker, movably housed in the upper portion of the movable body along a moving direction of the movable body, and engaged with the movable body in a reference position; and urging means structured so as to store an urging force when the catcher is in the reference position, wherein the catcher in the reference position captures the striker of the runner stopped and engaged with the rail in the self-propelling start position of the movable body, and an engagement between the catcher and the movable body is released upon a capture so that the urging force of the urging means is released, and wherein due to a backward movement of the movable body to the self-propelling start position from the stop position, the catcher is moved in the reference position again, and releases the striker of the runner, and an engagement between the runner and the rail is subsequently released.

2. A self-propelled forward movement mechanism for a movable body hung from a rail and supported by a hanging wheel to be moved forward by self propulsion to a stop position after the movable body has moved forward to a self-propelling start position, comprising;

a runner movably assembled to the rail;

a catcher housed to be movable along a moving direction in a concave extending along the moving direction of the movable body and formed in an upper portion of the movable body; and urging means of the catcher, wherein the runner includes a runner main body; and a striker projecting downwardly from the runner main body, entered into the concave, and positioned in front of the catcher;

wherein a runner main body includes a runner stopper having an outer end retractably projecting from a side portion of the runner main body, and always leaving a space between the outer end and an inner surface of the rail; a release part retractably projecting an outer end from a front portion of the runner main body facing a forward movement of the movable body; and an urging body urging and positioning the release part in a projecting position;

wherein the runner stopper is interconnected so as to be retractable relative to the release part when the release part is retracted against an urging force of the urging body;

wherein the catcher includes a catcher stopper having an outer end retractably projecting from a side portion of the catcher main body; a retaining body of the striker provided in the catcher main body to be movable forward and backward, and receiving the striker from a front side in a non-retaining state; and urging bodies for them, and wherein due to the urging bodies, when the catcher stopper is projecting the outer end thereof, the retaining body is in an advanced position and in a non-retaining state, and when the retaining body is in a backward position and in a retaining state, the catcher stopper retracts the outer end;

wherein in the concave, an engagement portion for engaging with the outer end of the catcher stopper is formed, and in a reference position of the catcher wherein the catcher stopper is engaged in the engagement portion, the urging means stores forces; and wherein the rail includes a first portion located on a backward movement side of the movable body, and retractably projecting due to an urging force; and a second portion positioned on a forward movement side of the movable body, and the engagement portion is formed between both portions and receives the outer end of the runner stopper to engage with this, and when the movable body has been moved to the self-propelling start position wherein the striker is advanced to the retaining body of the catcher which is in the reference position, the runner stopper of the runner is engaged with the engagement portion.

3. A self-propelled forward movement mechanism for the movable body according to claim 2, wherein the hanging wheel is provided between a front end of the movable body and the concave, and when the movable body in the stop position is moved backward, the hanging wheel hits an outer end of the release part, so that the release part is retracted.

4. A self-propelled forward movement mechanism for the movable body according to claim 2, wherein a wheel is provided on the side portion of the runner, said wheel traveling on an inner face of a lower portion of the rail.

5. A self-propelled forward movement mechanism for the movable body according to claim 2, wherein the runner includes a postural retaining portion located under an outer face of a lower portion of the rail and projecting downwardly through an opening formed at the lower portion of the rail and extending along a length direction of the rail.

6. A self-propelled forward movement mechanism for the movable body according to claim 2, wherein the striker is provided in a striker base rotatably assembled to the runner main body.

7. A self-propelled forward movement mechanism for the movable body according to claim 2, wherein the striker is provided with engagement portions corresponding to the retaining body and located in at least two portions with an interval along the moving direction of the movable body.

* * * * *